US007996103B2

(12) United States Patent
Yamada

(10) Patent No.: US 7,996,103 B2
(45) Date of Patent: Aug. 9, 2011

(54) EMBROIDERY DATA GENERATING APPARATUS AND COMPUTER READABLE MEDIUM STORING EMBROIDERY DATA GENERATING PROGRAM

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 491 days.

(21) Appl. No.: 12/292,625

(22) Filed: Nov. 21, 2008

(65) Prior Publication Data

US 2009/0138120 A1 May 28, 2009

(30) Foreign Application Priority Data

Nov. 26, 2007 (JP) ..... 2007-304116

(51) Int. Cl.
*D05C 5/02* (2006.01)

(52) U.S. Cl. ..... 700/138; 700/136; 112/102.5; 112/470.01

(58) Field of Classification Search ..... 700/136–138; 112/102.5, 103, 470.01, 470.04, 470.06
See application file for complete search history.

(56) References Cited

U.S. PATENT DOCUMENTS

| | | | | |
|---|---|---|---|---|
| 5,343,401 | A * | 8/1994 | Goldberg et al. | 700/138 |
| 5,751,583 | A * | 5/1998 | Kyuno et al. | 700/137 |
| 5,794,553 | A * | 8/1998 | Futamura | 112/102.5 |
| 5,839,380 | A * | 11/1998 | Muto | 112/102.5 |
| 6,629,015 | B2 | 9/2003 | Yamada | |

FOREIGN PATENT DOCUMENTS

JP A-2001-259268 9/2001

* cited by examiner

*Primary Examiner* — Nathan Durham
(74) *Attorney, Agent, or Firm* — Oliff & Berridge, PLC

(57) ABSTRACT

An embroidery data generating apparatus for embroidering image data configured by multiplicity of pixels including a color difference calculator calculating a color difference between sewing thread color of the target segment and an underpass segment underlying the target segment; an angular difference sum calculator calculating an angular difference between the underpass segment and the target segment, the angular difference being measured at an intersecting pixel where the target segment and the underpass segment intersect; a third determiner determining whether or not to append the target segment to the sequence information based on the angular difference when the sum of the color difference is determined to be equal to or less than the first predetermined value; and a second segment appender that appends the target segment between the focus segment and the subsequent segment when determined by the third determiner to append the target segment to the sequence information.

8 Claims, 16 Drawing Sheets

152

| ANGULAR FEATURE INFORMATION STORAGE AREA | | | | | |
|---|---|---|---|---|---|
| | LATERAL | | | | |
| | ... | m-1 | | m | |
| VERTICAL | ⋮ | ⋮ | | ⋮ | |
| | n-1 | ANGULAR FEATURE | ANGULAR FEATURE MAGNITUDE | ANGULAR FEATURE | ANGULAR FEATURE MAGNITUDE |
| | | 30 | 45 | 40 | 5 |
| | n | ANGULAR FEATURE | ANGULAR FEATURE MAGNITUDE | ANGULAR FEATURE | ANGULAR FEATURE MAGNITUDE |
| | | 50 | 70 | 70 | 5 |
| | n+1 | ANGULAR FEATURE | ANGULAR FEATURE MAGNITUDE | ANGULAR FEATURE | ANGULAR FEATURE MAGNITUDE |
| | | 15 | 80 | 80 | 90 |
| | ⋮ | ⋮ | | ⋮ | |

FIG. 3A

152

ANGULAR FEATURE INFORMATION STORAGE AREA

| | LATERAL | | | | | |
|---|---|---|---|---|---|---|
| | ... | m+1 | | | | ... |
| VERTICAL | ... | ... | ... | | ... | ... |
| | n-1 | ... | ANGULAR FEATURE | 30 | ANGULAR FEATURE MAGNITUDE | 8 | ... |
| | n | ... | ANGULAR FEATURE | 80 | ANGULAR FEATURE MAGNITUDE | 5 | ... |
| | n+1 | ... | ANGULAR FEATURE | 80 | ANGULAR FEATURE MAGNITUDE | 90 | ... |
| | ... | ... | | | | ... | ... |

FIG. 3B

| | | |
|---|---|---|
| 100 | 50 | 50 |
| 200 | 100 | 50 |
| 200 | 200 | 100 |

FIG. 7

| | | |
|---|---|---|
| 50 | 0 | * |
| 100 | 50 | * |
| 0 | 100 | * |

FIG. 8

| | | |
|---|---|---|
| 0 | 0 | * |
| 0 | 0 | * |
| * | * | * |

FIG. 9

| | | |
|---|---|---|
| 100 | 50 | 0 |
| 0 | 100 | 50 |
| * | * | * |

FIG. 10

| | | |
|---|---|---|
| * | 150 | 50 |
| * | 100 | 150 |
| * | * | * |

713

| | | | |
|---|---|---|---|
| 30 | 30 | | |
| | 45 | 30 | 30 |
| 0 | 0 | 45 | 0 |
| | | | 45 |

FIG.17

| | | | |
|---|---|---|---|
| 30 | 30 | −1 | −1 |
| −1 | 45 | 30 | 30 |
| 0 | 0 | 45 | 0 |
| −1 | −1 | −1 | 45 |

FIG.18

EMBROIDERY DATA GENERATING APPARATUS AND COMPUTER READABLE MEDIUM STORING EMBROIDERY DATA GENERATING PROGRAM

CROSS-REFERENCE TO RELATED APPLICATIONS

This application is based upon and claims the benefit of priority from the prior Japanese Patent Application 2007-304116, filed on Nov. 26, 2007, the entire contents of which are incorporated herein by reference.

FIELD

The present disclosure relates to an embroidery data generating apparatus that generates embroidery data for producing embroidery based on photo images with minimum use of jump stitches. The present disclosure also relates to a computer readable medium storing an embroidery data generating program.

BACKGROUND

Conventionally, photo image embroidering has been performed in which embroidery is produced based on photos taken by digital cameras or film cameras. Photo image embroidery uses sources such as image data taken by digital cameras, and scanned images of film. Based on such image data, segment data indicating shapes of stitches and thread color data indicating the color of stitches are generated to provide an embroidery data carrying color-by-color information of stitches.

Such embroidery data is generated by an embroidery data generating apparatus, one example of which is suggested in JP 2001-259268 A (hereinafter referred to as reference 1). In the disclosed embroidery data generating apparatus, in order to approximate the resulting embroidery to the original photo image, stitches are formed in various orientations fully spanning 360 degrees instead of being limited to a single orientation.

More specifically, for each pixel constituting the image data, orientation of stitch (angular feature) located on a given pixel and its magnitude (feature magnitude)are calculated for generating the segment data. The angular feature and its magnitude are calculated based on the luminance of the pixels surrounding the focus pixel where focus is currently being placed by the system and magnitude of angular feature increases as difference in luminance relative to the surrounding pixels increase.

When generating embroidery data, sewing sequence is determined as follows. First, among the segments sewn by the same thread color as the initially sewn segment, the segment located in the closest proximity of the initially sewn segment is searched and identified as the subsequently sewn segment. Likewise, among the segments sewn by the same thread color as the subsequently sewn segment, the closest segment is searched and identified as the next segment. A running stitch is formed from a start point to an end point of a segment, whereas a jump stitch is formed from the end point of the current stitch to the start point of the subsequent segment. The above described procedure is repeated for each thread color to generate the embroidery data.

Jumping stitch requires the jump thread to be removed after it has been sewn. Further, while the jumping stitch is being formed, reverse stitch needs to be formed to prevent the thread from coming out of the location where the jump stitch is subsequently cut. Stated differently, jump stitch requires cumbersome task when it is being sewn and after it has been sewn.

In order to minimize jump stitches, embroidery data with jump stitches converted into running stitches are generated when predetermined conditions are met. The first of the two predetermined conditions is that a running stitch is sewn over the jump stitch with another thread. In such case, since the jump stitch is covered by another thread, converting the jump stitch into a running stitch will not be a problem. The second of the two predetermined conditions is that when a thread needs to be sewn underneath the jump stitch, the difference between color of the thread sewn underneath and the thread color of the jump stitch needs to be equal to or below a predetermined similarity threshold. If the color of thread sewn underneath and the color of threads in its periphery have little difference, converting the jump stitch into a running stitch will not render the running stitch conspicuous.

However, even if the difference between the color of the thread sewn underneath and the thread color of the jump stitch is at or below the similarity threshold to meet the second predetermined condition, the direction of the stitch may render the running stitch conspicuous even if it does not stand out in terms of thread color. One such example is shown in FIG. 26 of the present exemplary embodiment. As can be seen in area 900 of FIG. 26, when stitches inclined by approximately 90 degrees are formed continuously in an area where most of the stitches are inclined by substantially 0 degrees, the series of continuous stitches, being directed in a different orientation from the rest of the stitches naturally stand out. Stated differently, when stitch/stitches being considerably inclined relative to the underlying stitches are formed in a substantial length, it/they may impair the look of the outcome of the sewing operation.

SUMMARY

An object of the present disclosure is to provide an embroidery data generating apparatus that generates embroidery data for producing embroidery based on photo images with minimum use of jump stitches. Another object of the present disclosure is to provide a computer readable medium storing an embroidery data generating program.

An embroidery data generating apparatus for use in forming embroidery with a sewing machine based on image data configured by multiplicity of pixels that represent a given image, the embroidery data generating apparatus including an angular feature information calculator that calculates angular feature information configured by an angular feature indicative of orientation showing high degree of color continuity and an angular feature magnitude indicative of color continuity magnitude for each pixel configuring the image data; an angular feature information storage that stores the angular feature information; a segment data generator that generates segment data that describes placement of segments, representing sewing threads, overlying each of the pixels based on the angular feature information stored in the angular feature information storage; a color data generator that generates color data indicative of sewing thread color of each segment described in the segment data based on the image data; a segment sequence determiner that determines sequence of the segments within the segments classified by color based on the segment data and the color data; a sequence information storage that stores sequence information indicative of the sequence of segments determined by the segment sequence determiner; a first determiner that determines whether or not to append a target segment to the sequence information depending upon whether or not the target segment is covered by a predetermined percentage or greater by an overpass segment overlying the target segment, the target segment being a segment connecting an end point of a focus segment and a start point of a subsequent segment being subsequent in sequence to the focus segment; a first segment appender that appends the target segment between the focus segment and the subsequent segment of the sequence information when determined by the first determiner to append the target segment to the sequence information; a color difference calculator that calculates a color difference between sewing thread color of the target segment and sewing thread color of an underpass segment underlying the target segment; a second determiner that determines whether or not a sum of the color difference for all the underpass segments associated with the target segment is equal to or less than a first predetermined value; an angular difference calculator that calculates an angular difference between the underpass segment and the target segment, the angular difference being measured at an intersecting pixel where the target segment and the underpass segment intersect; a third determiner that determines whether or not to append the target segment to the sequence information based on the angular difference when the sum of the color difference is determined to be equal to or less than the first predetermined value; a second segment appender that appends the target segment between the focus segment and the subsequent segment of the sequence information when determined by the third determiner to append the target segment to the sequence information; and an embroidery data generator that generates, based on the sequence of the segments indicated in the sequence information, embroidery data that identifies the segment as a running stitch and if an end point of the segment and a start point of a subsequent segment subsequent in sequence are not coincidental, the end point of the segment and the start point of the subsequent segment are identified to be joined by a jump stitch.

According to the above described embroidery data generating apparatus, sequence of segments classified by thread color may be determined based on the segment data and the color data to be stored as the sequence information. The two segments continuous in sequence within the sequence information are referred to as the focus segment and the subsequent segment. A straight line connecting the end point of the focus segment and the start point of the subsequent segment is referred to as the target segment. The target segment may or may not be added to the sequence information based on the angular difference between the target segment and its underlying underpass segment. Path of running stitches are defined based on the sequence of segments stored in the sequence information. The portion between the running stitches, in other words, the portion corresponding to the target segment is identified as jump stitches. Thus, appending the target segment to the sequence information denotes converting the jump stitches into running stitches. Jump stitches may or may not be converted into running stitches based on the angular difference between the target segment and its underlying segment. If the angular difference between the target segment sewn as a running stitch and its underlying segment, that is, the underlying stitch is so great to render the converted running stitch to stand out, the target segment may be maintained as a jump stitch without converting to a running stitch. Thus, a conspicuously oriented stitch can be prevented from being formed to maintain the look of the resulting embroidery.

A computer readable medium storing an embroidery data generating program for use in forming embroidery with a sewing machine based on image data configured by multiplicity of pixels that represent a given image, the embroidery data generating program including instructions for calculating angular feature information configured by an angular feature indicative of orientation showing high degree of color continuity and an angular feature magnitude indicative of color continuity magnitude for each pixel configuring the image data; instructions for storing the angular feature information; instructions for generating segment data describing placements of segments, representing sewing threads, overlying each of the pixels based on the angular feature information; instructions for generating color data indicative of sewing thread color of each segment of the segment data based on the image data; instructions for determining sequence of the segments within the segments classified by color based on the segment data and the color data; instructions for storing the sequence information; instructions for determining whether or not to append a target segment to the sequence information depending upon whether or not the target segment is covered by a predetermined percentage or greater by an overpass segment overlying the target segment, the target segment being a segment connecting an end point of a focus segment and a start point of a subsequent segment being subsequent in sequence to the focus segment; instructions for appending the target segment between the focus segment and the subsequent segment of the sequence information when determined to append the target segment to the sequence information; instructions for calculating a color difference between sewing thread color of the target segment and sewing thread color of an underpass segment underlying the target segment; instructions for determining whether or not a sum of the color difference for all the under pass segments associated with the target segment is equal to or less than a first predetermined value; instructions for calculating an angular difference between the underpass segment and the target segment, the angular difference being measured at an intersecting pixel where the target segment and the underpass segment intersect; instructions for determining whether or not to append the target segment to the sequence information based on the angular difference when the sum of the color difference is determined to be equal to or less than the first predetermined value; instructions for appending the target segment between the focus segment and the subsequent segment of the sequence information when determined to append the target segment to the sequence information; and instructions for generating, based on the sequence of the segments indicated in the sequence information, embroidery data that identifies the segment as a running stitch and if an end point of the segment and a start point of a subsequent segment subsequent in sequence are not coincidental, the end point of the segment and the start point of the subsequent segment are identified to be joined by a jump stitch.

The embroidery data generating program stored in the above described computer readable medium being executed by the embroidery data generating apparatus, provides the operation and effects provided by the above described embroidery data generating apparatus.

BRIEF DESCRIPTION OF THE DRAWINGS

Other objects, features and advantages of the present disclosure will become clear upon reviewing the following description of the illustrative aspects with reference to the accompanying drawings, in which.

FIG. 3A is a schematic diagram of angular feature information storages 152;

FIG. 3B is a schematic diagram of angular feature information storages 152;

FIG. 7 schematically indicates luminance of a given pixel and its surrounding pixels;

FIG. 8 schematically indicates absolute difference in pixel value between each pixel and its rightward adjacent pixel;

FIG. 9 schematically indicates absolute difference in pixel value between each pixel and its lower right adjacent pixel;

FIG. 10 schematically indicates absolute difference in pixel value between each pixel and its lower adjacent pixel;

FIG. 17 schematically indicates angular information representing pass-through segment 713;

FIG. 18 schematically indicates resulting angular information;

DETAILED DESCRIPTION

One exemplary embodiment of an embroidery data generator 1 in accordance with the present exemplary embodiment will be described with reference to the drawings. Embroidery data generator 1 of the present exemplary embodiment generates embroidery data based on a given image data. The embroidery data representing the image data is processed by an embroidery sewing machine 3 to form an embroidery pattern. A description will first be given hereinafter on embroidery sewing machine 3.

Figure 1:
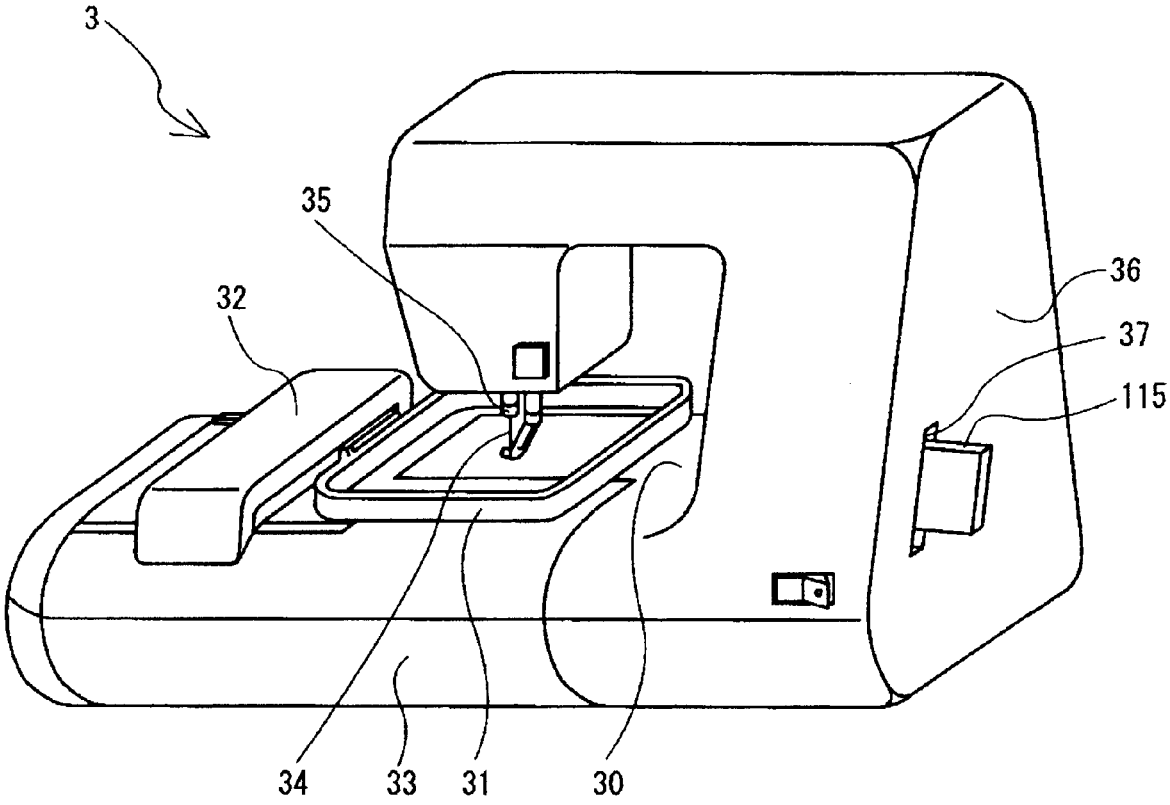
FIG. 1 is a perspective view of en embroidery sewing machine 3.

Embroidery sewing machine 3 forms an embroidery pattern representing the processed image on a workpiece cloth by holding the workpiece cloth with an embroidery frame 31 and transferring embroidery frame 31 to predetermined positions located in an X-Y coordinate system employed by the system. Embroidery frame 31 is driven by a Y-directional driver 32, and an X-directional driving mechanism (not shown) which is contained in a body case 33 shown in FIG. 1. Components such as the aforementioned Y-directional driver 32 and X-directional driving mechanism, and a needle bar 35 are controlled by a controller (not shown) configured by a microcomputer, or the like, provided in embroidery sewing machine 3. The embroidery data generated by embroidery data generator 1 is provided to embroidery sewing machine 3 by medium such as a memory card 115, for example, which is inserted into a slot 37 provided on a side surface of pillar 36 of embroidery sewing machine 3.

Figure 2:
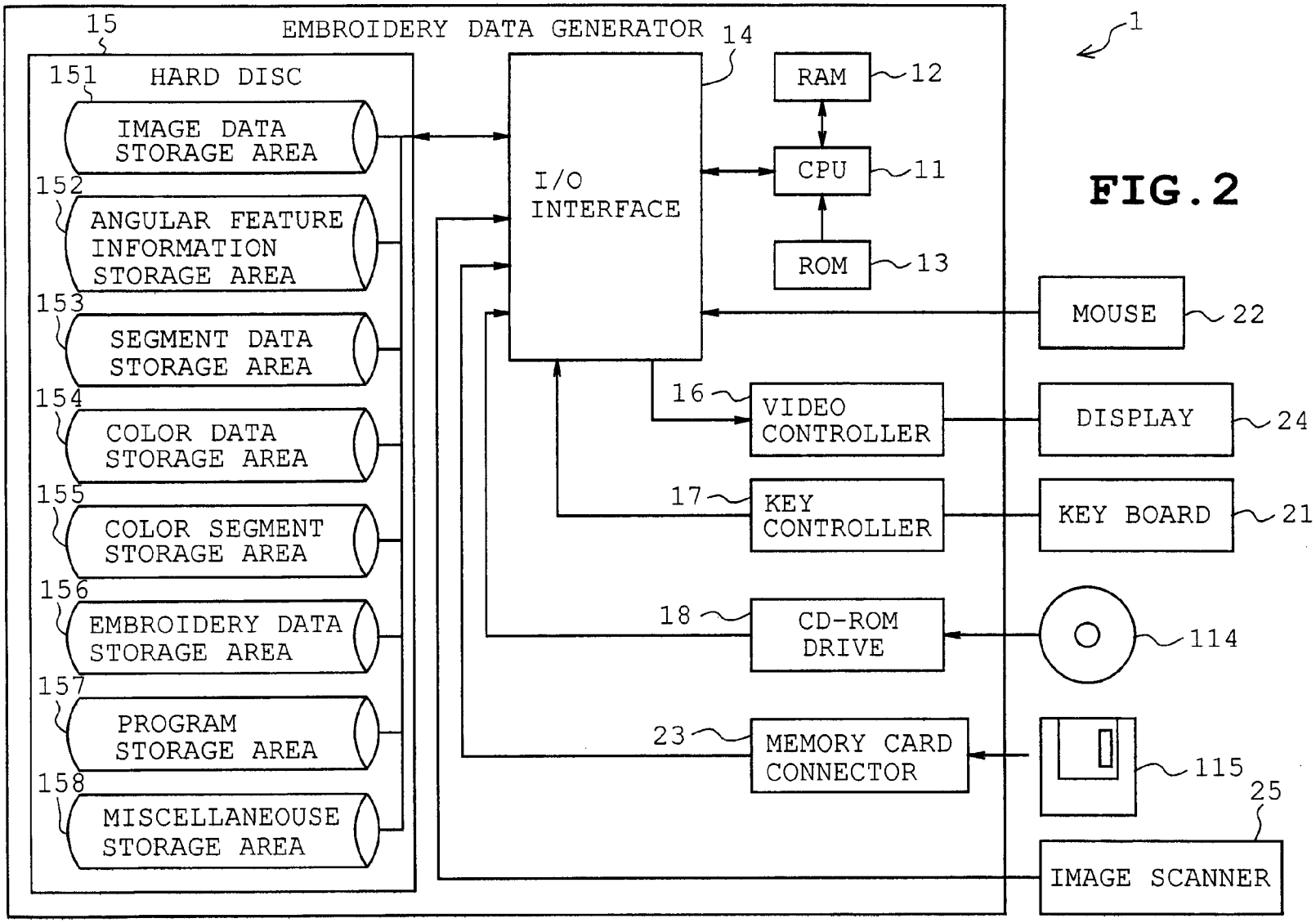
FIG. 2 is a block diagram of an electrical configuration of an embroidery data generator 1.

Electrical configuration of embroidery data generator 1 will be described with reference to a block diagram shown in FIG. 2. Embroidery data generator 1 comprises a personal computer (PC) which is connected to a key board 21, a mouse 22, a display 24, and an image scanner 25. As can be seen in FIG. 2, embroidery data generator 1 is provided with a CPU 11 which is responsible for its control. CPU 11 is connected to a RAM 12, a ROM 13 and an I/O interface 14. RAM 12 serves as a temporary storage for various data, whereas ROM 13 stores programs such as BIOS, and I/O interface 14 that mediates data communication between system components. I/O interface 14 is connected to a hard disc 15. Hard disc 15 includes but not limited to an image data storage area 151, an angular feature information storage area 152, a segment data storage area 153, a color data storage area 154, a color segment data storage area 155, an embroidery data storage area 156, a program storage area 157, and miscellaneous information storage area 158.

Image data storage area 151 stores image data read by image scanner 25. Angular feature information storage area 152 stores angular feature information containing angular feature and angular feature magnitude for each pixel constituting the image data. Segment data storage area 153 stores segment data configured by angular feature information. The segment data represents each stitch constituting the embroidery by a segment. Color data storage area 154 stores color data configured by segment data and image data. The color data indicates the color (color of embroidery thread) of the segment represented by the segment data. Color segment data storage area 155 stores sequence information containing information on segments indicated in segment data classified by color and appended with sequence. Embroidery data storage area 156 stores embroidery data configured by color data and segment data. The embroidery data is used when embroidering with embroidery sewing machine 3 and includes information such as stitch position and stitch pitch for each embroidery thread. Program storage area 157 stores embroidery data generating program which is executed by CPU 11. Miscellaneous information storage area 158, collectively represented by reference symbol 158 stores miscellaneous information used by embroidery data generator 1. If embroidery data generator 1 is provided as an independent machine without hard disc 15, the programs are stored in the ROM.

I/O interface 14 establishes connections with components such as mouse 22, a video controller 16, a key controller 17, a CD-ROM drive 18, a memory card connector 23, and image scanner 25. Video controller 16 is connected to a display 24, and key controller 17 is connected to key board 21. CD-ROM drive 18 receives a CD-ROM 114 containing an embroidery data generating program serving as a control program for controlling embroidery data generator 1. When deployed, the control program is retrieved from CD-ROM 114 to be set up to hard disc 15 and stored in program storage area 157. Memory card connector 23 allows reading and writing of memory card 15.

A description will now be given on the angular feature information stored in angular feature information storage area 152. The angular feature information represents angular feature and angular feature magnitude which are calculated pixel by pixel. Angular feature of a given pixel indicates the orientation (angle) of continuity of color when the color of the pixel is compared with the peripheral pixels. The angular feature magnitude indicates the magnitude (level) of continuity. The angular feature not only indicates the color continuity with adjacent pixels but also with pixels residing in greater area. Stated differently, angular feature is a numeric representation of the orientation of color continuity perceived by the user when the image is viewed from a distance. When generating a segment for a given pixel, the incline of the segment represents the angle indicated by the angular feature. Angular feature magnitude of a given pixel, on the other hand, is used as a reference for comparison with the angular feature magnitude of the peripheral pixels to determine whether or not to proceed with the embroidery represented by the segment of the focus pixel and if not, to delete the segment.

As can be seen in FIG. 3, angular feature information storage area 152 comprises a two-dimensional array. Number of rows arranged in the array represents the number of vertically disposed pixels, whereas the number of columns arranged in the array represents the number of laterally disposed pixels. An element of the two-dimensional array contains "angular feature" and "angular feature magnitude" and thus, a single array element stores the angular feature and angular feature magnitude of a single pixel.

Next, a process flow for generating the embroidery data from the image data will be described with reference to FIG. 4. CPU 11 of embroidery data generator 1 executes an embroidery data generating program pursuant to the flowchart indicated in FIG. 4, which will be described in detail hereinafter.

As the first step of the control, CPU 11 inputs the image data for generating the embroidery data (S1). The image data is inputted by capturing images with image scanner 25, and by selecting a file containing image data stored in an external storage device or hard disc 15. The inputted image data is then stored in image data storage area 151. The image data comprises a multiplicity of pixels and each pixel has parameters such as "contrast" indicative of coloring, "luminance" indicative of color brightness, and "saturation" indicative of colorfulness associated with it. Matrix alignment of the above described pixels constitute an image.

CPU 11, after inputting the image data for generating embroidery data and storing it in image data storage area 151 (S1), calculates angular feature and angular feature magnitude of each pixel contained in the image data to generate angular feature information (S2). The calculation for obtaining the angular feature and angular feature magnitude will be described in detail with reference to FIGS. 8 to 10.

First, CPU 11 produces a gray scale of the inputted image data to covert the color image into a monochrome image. The conversion is made pixel by pixel by processing the scale of multiple color components constituting the color image into a gradient (luminance) of a single color component constituting the monochrome image. In the present exemplary embodiment, the color image comprises 3 primitive color components known as RGB (Red, Green, Blue), and among the RGB values of each pixel value, ½ of the sum of the maximum value and the minimum value is specified as the "luminance" indicative of the brightness of the pixel. For instance, "luminance" of a given pixel having an RGB value of (200, 100, 50) can be given by the equation (200+50)÷2=125. Alternative approach may be taken to produce a gray scale such as specifying the maximum value among the RGB values of each pixel value as the "luminance".

Then, CPU 11 converts the gray scale of the image data by a well known high pass filter. Based on the image converted by the high pass filter, CPU 11 calculates the angular feature and the angular feature magnitude as detailed as follows. First, CPU 11 focuses on a given pixel constituting the image and calculates the angular feature of the pixel value that the focused pixel (hereinafter also referred to as focus pixel) indicates with reference to an N number of peripheral pixels. For simplicity, the calculation will be exemplified assuming that N=1. As apparent from the above description, N indicates the distance of the peripheral pixels from the focus pixel, meaning that if N=1, only the pixels in neighboring contact with the focus pixel is referred, and if N=2, pixels in neighboring contact with the focus pixel and the pixels surrounding such pixels are referred.

For instance, FIG. 7 schematically indicates a block of 3×3 pixels centered on the focus pixel having "luminance" as shown. Luminance is specified by a numeric ranging from 0 to 255, where 0 represents "black" and "255" represents "white". The luminance of the focus pixel, as shown, is "100", and the peripheral pixels listed in clockwise sequence from the upper left pixel is "100", "50", "50", "50", "100", "200", "200", and "200".

Figures 11, 12:
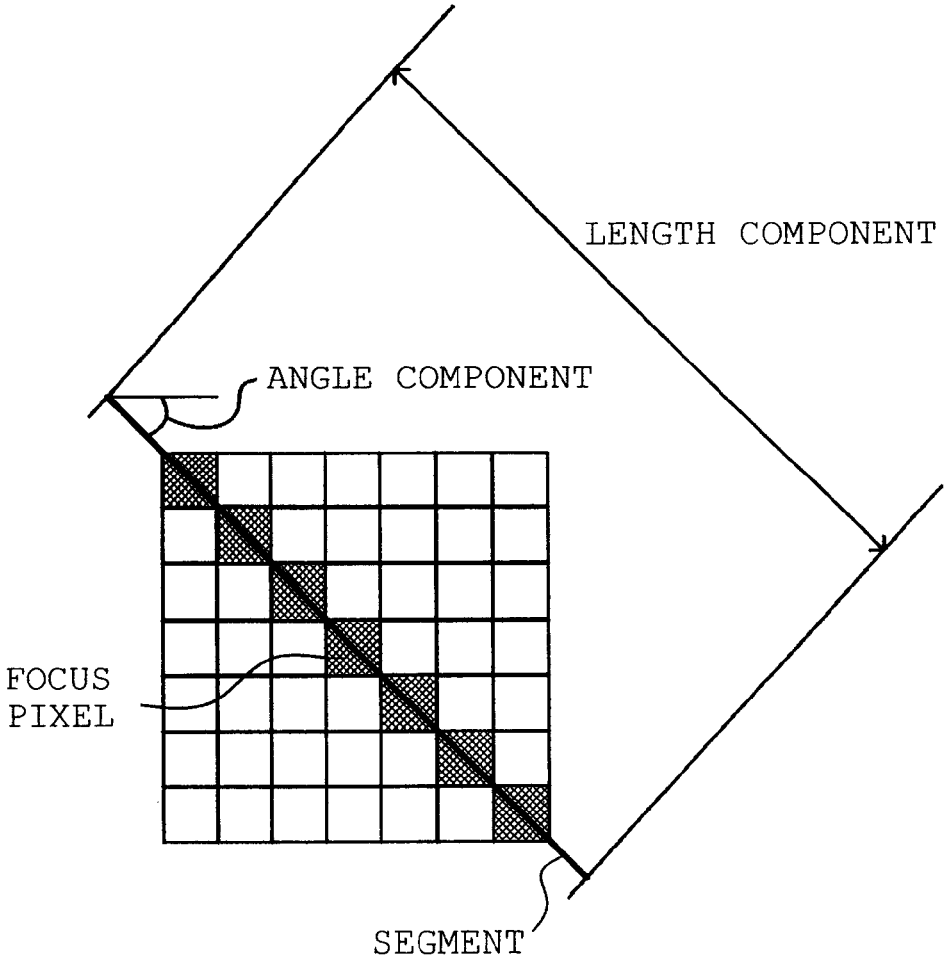
FIG. 11 schematically indicates absolute difference in pixel value between each pixel and its lower left adjacent pixel.
FIG. 12 schematically indicates an angular component and a length component of a given pixel when the angular component is 45 degrees.

As the first step in calculating the angular feature, CPU 11 first calculates the absolute difference between each pixel value with its rightwardly adjacent pixel value. FIG. 8 schematically indicates the obtained difference. As can be seen in FIG. 8, the three rightmost pixels are represented by "*" since the difference cannot be obtained due to absence of rightwardly adjacent pixel. The focus pixel, as shown, indicates luminance of "100" and its rightwardly adjacent pixel indicates luminance of "50", which results in absolute difference of "50". Then, CPU 11 obtains the absolute difference with the lower right pixel, the lower pixel, and the lower left pixel. FIGS. 9, 10, and 11 schematically show the results obtained. Based on these results, CPU 11 obtains "normal angle of angular feature" corresponding to the orientation having a high degree of discontinuity in the pixel value within the area. Then, CPU 11 adds 90 degrees to "normal angle of angular feature" to obtain the "angular feature".

More specifically, CPU 11 obtains the sum (represented as Tb, Tc, Td, and Te) of absolute differences obtained by the result of calculation in each direction. In the present exemplary embodiment, Tb represents the sum of the calculation in the rightward direction; Tc represents the sum in the lower right; Td, the lower direction; and Te, the lower left; and the sum in each direction amounts to Tb=300, Tc=0, Td=300, and Te=450. CPU 11 calculates the sum of horizontal components and vertical components, respectively from sums Tb, Tc, Td, and Te to calculate an arc tangent. At this instance, the horizontal and vertical components of the lower right direction and the horizontal and vertical components of the lower left direction are considered to offset each other.

When Tc>Te, in other words, when sum Tc of the lower right direction (45 degrees) is greater than sum Te of the lower left direction (135 degrees), since the desired result is 0 to 90 degrees, CPU 11 considers the lower right direction as a plus component in the horizontal and vertical component and the lower left direction as a minus component in the horizontal and vertical component to obtain the sum of horizontal component by Tb+Tc−Te, and the sum of the vertical component by Td+Tc−Te.

In contrast when Tc<Te, in other words, when sum Tc of the lower right direction is less than sum Te of the lower left direction, since the desired result is 90 to 180 degrees, CPU 11 considers the lower left direction as a plus component in the horizontal and vertical component and the lower right direction as a minus component in the horizontal and vertical component to obtain the sum of horizontal component by Tb−Tc+Te, and the sum of the vertical component by Td−Tc+e. At this time, since the desired value is 90 to 180 degrees, CPU 11 multiplies the entire equation by −1 prior to calculation of arc tangent.

To describe by way of example, since Tc<Te in FIGS. 8 to 11, the desired value is 90 to 180 degrees. The sum of horizontal component is obtained by Tb−Tc+Te=300−0+450=750, and the sum of vertical component is obtained by 300−0+450=750, and the equations are multiplied by −1 prior to calculation of arc tangent to obtain an ARCTAN (−750/750)=−45 degrees. The resultant angle is the "normal angle of angular feature" and is indicative of the orientation in which the pixel value within the targeted area is highly discontinuous. Thus, the angular feature of the focus pixel, in this case, is −45+90=45 degrees. Since the lower right direction is considered as the plus component in the horizontal and the vertical component, the obtained 45 degrees is directed in the lower right direction. Thus it can be understood from the above described example that the angular feature is obtained by the difference in the color information of the focus pixel and the peripheral pixels. Though, the color information, in this case, is configured by the brightness (luminance) of specified for each pixel, the same effect can be obtained by utilizing saturation or colorfulness.

The magnitude of the angular feature obtained by the above described steps is given by the following equation (1). In this case, the sum of difference in luminance from the peripheral pixels is the total sum of Tb, Tc, Td, and Te, it can be given by (300+0+300+450)×(255−100)÷255÷16=39.9. The angular feature indicates the orientation of change in brightness and the feature magnitude indicates the magnitude of change in brightness. The angular feature magnitude can be given by the following equation (1).

$$\text{Angular feature magnitude} = \frac{\text{total sum of angular difference} \times (255 - \text{target pixel value})}{255 \times (N \times 4)^2} \quad (1)$$

The angular feature and the feature magnitude of each pixel maybe obtained by applying a well known PREWITT or SOBEL operator, or the like, to the gray scale of the image. When applying the SOBEL operator, for instance, assuming that sx represents the result of application of a horizontal operator and sy represents the result of application of vertical operator, respectively at coordinate (x, y), the angular feature and magnitude can be obtained by the following equations (2a) and (2b).

$$\text{Angular Feature} = \tan^{-1}\left(\frac{sy}{sx}\right) \quad (2a)$$

$$\text{Angular Feature Magnitude} = \sqrt{sx \times sx + sy \times sy} \quad (2b)$$

Figure 4:
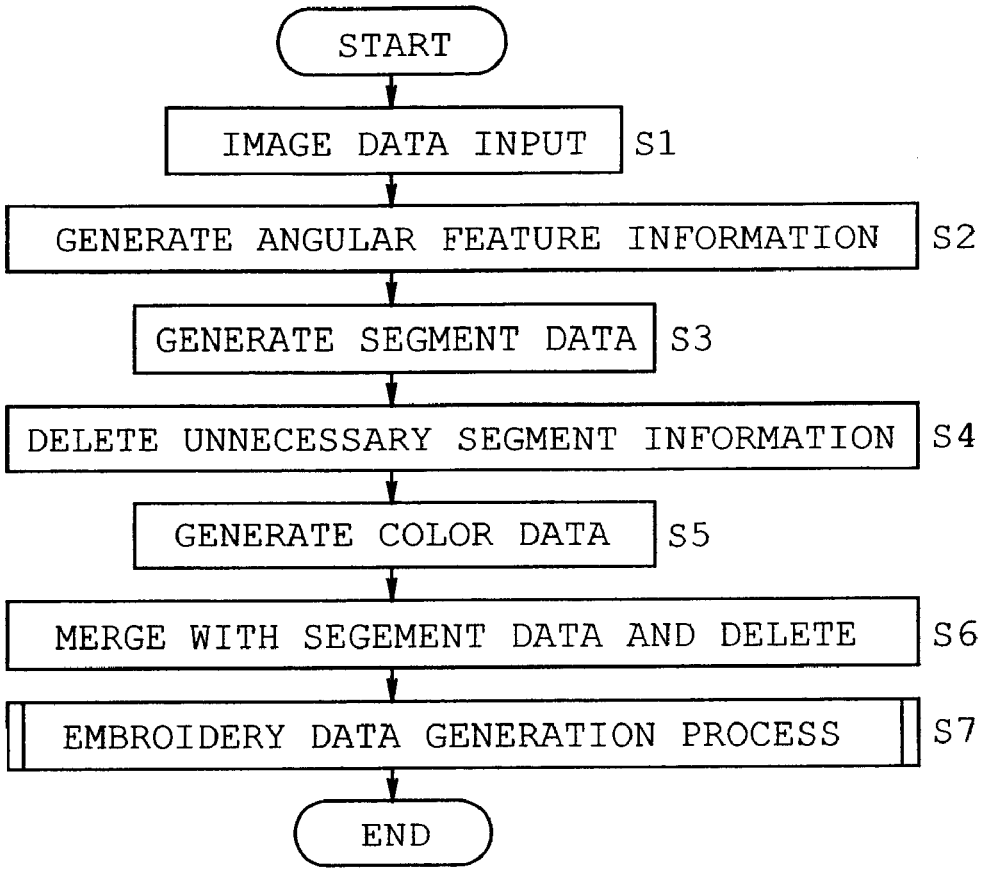
FIG. 4 indicates a flowchart of a main process.

As described above, CPU 11 calculates the angular feature and the angular magnitude corresponding to each pixel of the image data and stores them into angular feature information storage area 152 as angular feature information (S2 in FIG. 4). When, the size of image data is 150 pixel×150 pixel, CPU 11 stores the angular feature and the angular feature magnitude in angular feature information storage area 152 in an array of 150×150.

Then CPU 11 generates segment data from the angular feature information stored in angular feature information storage area 152 and stores it in segment data storage area 153 (S3). At this stage, CPU 11 generates segment information configured by an angular component and a length component for each pixel. The aggregation of segment information generated from the angular feature information makes up the segment data. CPU 11 sets the angular feature stored in the angular feature information to the angular component as it is, but sets a fixed value or the user input value to the length component. More specifically, CPU 11, as shown in FIG. 12, generates segment information such that a segment having the specified angular component and the length component is disposed to center on the focus pixel.

Under a configuration where segment information is generated for all the pixels constituting the image, the number of stitches formed in the subsequent embroidery operation, being based on the embroidery data configured by the segment data, may become excessive or redundant, consequently impairing the work quality. Under such configuration, since the segment information is generated unexceptionally even for pixels with relatively small angular feature magnitude, the resulting embroidery data as a whole may not effectively reflect the feature of the original image. CPU 11, thus sequentially scans the pixels constituting the image from the left to the right and up and down so that segment information is generated only when the angular feature magnitude of a given pixel is greater than a predetermined threshold. The "threshold of the angular feature magnitude" may be a preset fixed value or a value inputted by the user.

After generating the segment data as described above (S3), CPU 11 deletes segment information pertaining to inappropriate or unrequired segment from the segment data stored in segment data storage area 153 (S4) in the later described embroidery data generating process. More specifically, CPU 11 sequentially scans all the pixels constituting the image from the left uppermost portion of the image and executes the following process for all the pixels for which segment information has been formed.

First, CPU 11 searches for a pixel having segment information similar to the focus pixel and upon encountering similar segment information, CPU 11 deletes the segment information having less angular feature magnitude. More specifically, CPU 11 scans all the pixels existing on the extension of the segment defined by the segment information generated for the focus pixel. The extent to which scan is performed may be predetermined and fixed by the system or may be editably specified by user input. Then, upon encountering a pixel having similar angular feature, if the angular feature magnitude is greater than the angular feature magnitude of the focus pixel, the segment information of the encountered pixel is deleted. If the angular feature magnitude of the encountered pixel is greater than the angular feature magnitude of the focus pixel, the segment information generated for the focus pixel is deleted. The present exemplary embodiment sets a scanning range, that is, the extent to which scanning is performed to N multiple of the length component of segment information generated for the focus pixel. The similarity of the pixels are determined by evaluating whether angular feature falls within a similarity range represented as "±θ". The parameter "N" for determining the range and "±θ" for determining the similarity in the angular feature may be fixed at a predetermined value or may be editably specified by the user input.

As described above, CPU 11, after deleting unrequired segment information (S4), generates color data for each segment (S5). The color data indicative of color component of the segment is configured by using image data and segment data. In determining the color component of each segment, various settings need to be inputted for the color of the embroidery thread to be used such as: number of sewing thread colors, sewing thread color information (RGB values) for each color used, and color code. Then, based on the inputted information, CPU 11 generates a thread color mapping table. At the same time, CPU 11 also determines the sewing sequence for each thread color. The above settings on thread color and the sewing sequence of each thread color may be preset or may be set by user input through an input interface such as an input screen. The thread color mapping table may be prepared in advance to allow the user to select a thread color to be used.

A detailed description will be given hereinafter on generation of color data. First, CPU 11 sets a reference size to determine the scope in which reference is made to the color elements contained in the image data. One example of a reference scope may be an area enclosed by two sets of parallel lines. The first set of lines is placed at both sides of the segment such that the segment runs between the set of lines. The second set of lines is arranged to be perpendicular to the ends of the segment. The reference size represents the distance (such as number of pixels or length of embroidery stitch) of the segment, specified by the segment information, from the set of parallel lines. Then, CPU 11 generates a converted image of the image data being equal in size as the image data to a converted image storage area (not shown) provided in RAM 12 in order to draw the segment. The scope from which color elements are referred may be preset or may be set by user input.

Next, CPU 11 sets a reference area for drawing the segment specified by the segment information generated for a given focus pixel on the converted image. A sum Cs1 of RGB values is obtained for all the pixels within the reference area. CPU 11 identifies count of pixels used to calculate sum Cs1 as d1. Pixels on which the segment is not drawn (does not pass through) and pixels through which a segment is yet to be drawn is not included in the calculation.

CPU 11 also calculates a sum Cs2 of RGB values for pixels within the corresponding reference area for the image data as well. CPU 11 identifies the number of pixels within the reference are as d2.

CPU 11 identifies the count of pixels for which segment is to be subsequently drawn as s1 and calculates CL given by (Cs1+CL×s1)÷(s1+d1)=Cs2÷d2. This means that when color CL is set for segments to be subsequently drawn, the average of color of segments within the reference area and the average of color of segments within the corresponding reference area within the original image are equal.

Finally, among the inputted thread colors, CPU 11 obtains a thread color which is least distant from color CL of the segment within the RGB space and stores the obtained thread color as the color component of the segment into color data storage area 154. When RGB values of the calculated color CL is represented as r0, g0, and b0, and RGB values of input thread colors are represented by rn, gn, and bn, distance d within RGB space can be given by the following equation (3)

$$d=\sqrt{(r0-rn)^2+(g0-gn)^2+(b0-bn)^2} \quad (3)$$

After generating the color data as described above, CPU 11 reassess each segment information in view of color component and merges or deletes segment information in the segment data (S6). When CPU 11 encounters segments, specified by segment data, that are co-linear and identical in color; in other words, segments that are identical in angular and color components, and that partially overlap, multiplicity of segment data is merged into single segment data. By merging the multiplicity of segment data into single segment data, embroidery sewing can be carried out with embroidery data having less number of stitches without compromising the quality and efficiency of the sewing operation.

When the segments are located according to the sewing sequence set at S6 by CPU 11, some segments having a given color component may be partially hidden by later located segments having different color components. In such case, a percentage of exposure, hereinafter referred to as an exposure rate is calculated for the underlying hidden segment covered by segments of other color components. When encountering a segment having an exposure rate which is less than a predetermined threshold (minimum exposure rate), CPU 11 deletes such segment data. By deleting the segment data having relatively small exposure rate and thus having little contribution in the resulting image, embroidery sewing can be carried out with embroidery data having less number of stitches without compromising the quality and efficiency of the sewing operation. The threshold (minimum exposure rate) may be preset and fixed or may be set by user input.

Figure 5:
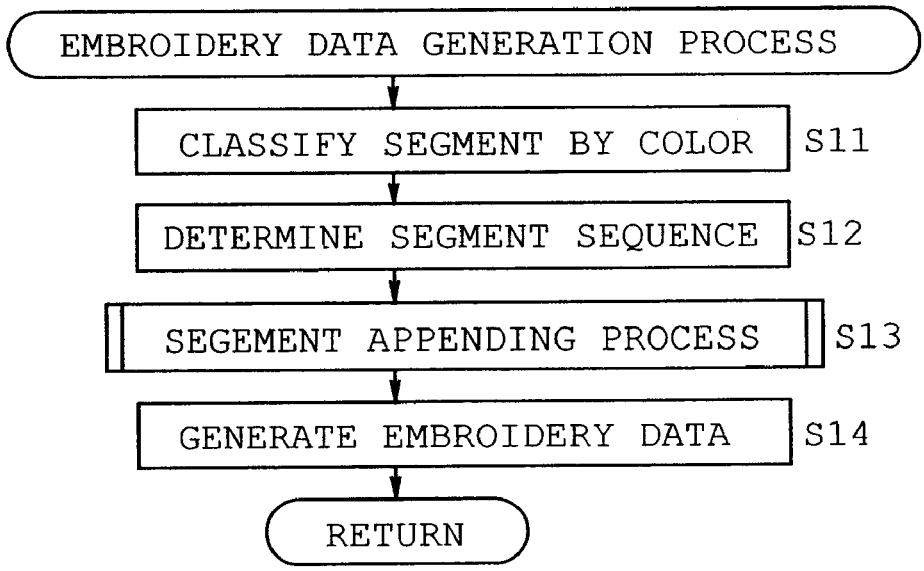
FIG. 5 indicates a flowchart of an embroidery data generation process of the main process.
Figure 6:
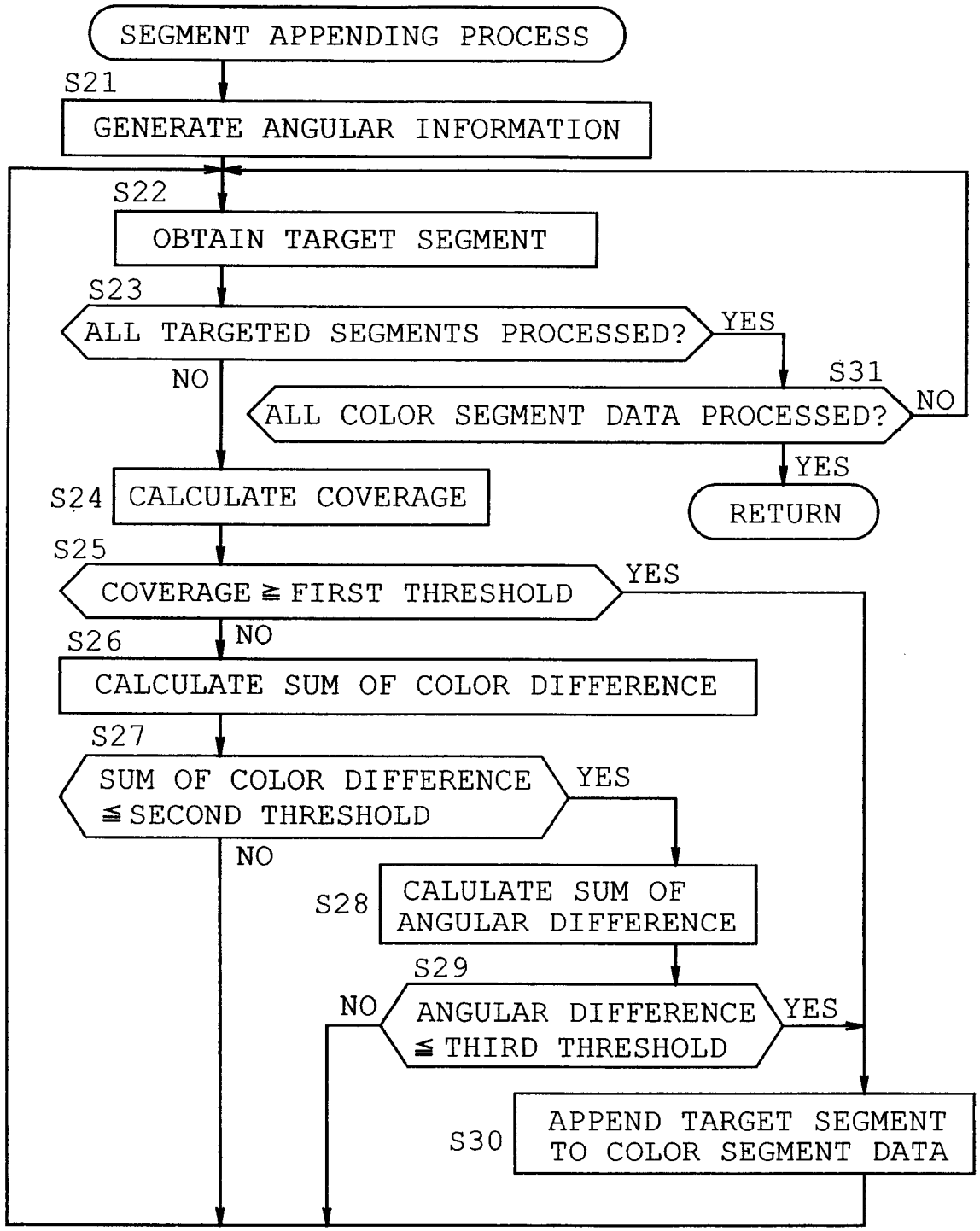
FIG. 6 indicates a flowchart of a segment appending process executed in the embroidery data generating process.

Next, CPU 11 generates embroidery data (refer to S7 of FIG. 5 and FIG. 6). As can be seen in FIG. 5, as the first step of embroidery data generation process, the segment data stored in segment data is classified by color (S11). The color data stored in color data storage area 154 includes color component for each segment which is a component configuring the segment data. CPU 11 groups the segments by color components such that the segments are distributed into 10 groups if there are 10 color components. Segment data is generated for representing each segment group containing segments of the same color component, and such segment data is identified as "color segment data".

Next, CPU 11 determines the sewing sequence of the segments for each color segment data (S12). More specifically, CPU 11 extracts the segment having an end point which has the left uppermost location among the color segment data for which sewing sequence is determined. CPU 11 identifies the extracted segment as a "start segment" which is sewn first, and identifies the left uppermost terminal point as a "start point" and its opposite point as an "end point". CPU 11 then, extracts a segment having a terminal point which is in closest distance from the end point. Then, CPU 11 identifies the extracted segment as the second segment of the sequence and identifies the terminal point in closest distance from the end point of the previous segment as the "start point" of second segment and the opposite point as the "end point". Similarly, CPU 11 extracts a segment having a terminal point in closest distance from the end point and identifies the segment as the next segment of the sequence. CPU 11 repeats the above described process and appends a segment in closest distance from the last segment of the sequence as the next segment of the sequence to determine the sewing sequence of all the segments.

Segments constituting the color segment data correspond to the stitches being actually sewn in the sewing process as "running stitches". Stitches are sewn in the sequence determined at S12. For instance, if the end point of a given segment (focus segment) is coincidental with the start point of the next segment (subsequent segment) of the sequence, it means that the stitches are continuous. Hence, the two continuous stitches are sewn as "running stitch". If the end point of the focus segment and the start point of the subsequent segment are not coincidental, the stitches are discontinuous. In such case, after sewing the stitch corresponding to the focus segment as "running stitch", the end point of the focus segment and the start point of the subsequent segment are connected by a "jump stitch" and the subsequent segment is thereafter sewn as a "running stitch".

Figure 13:
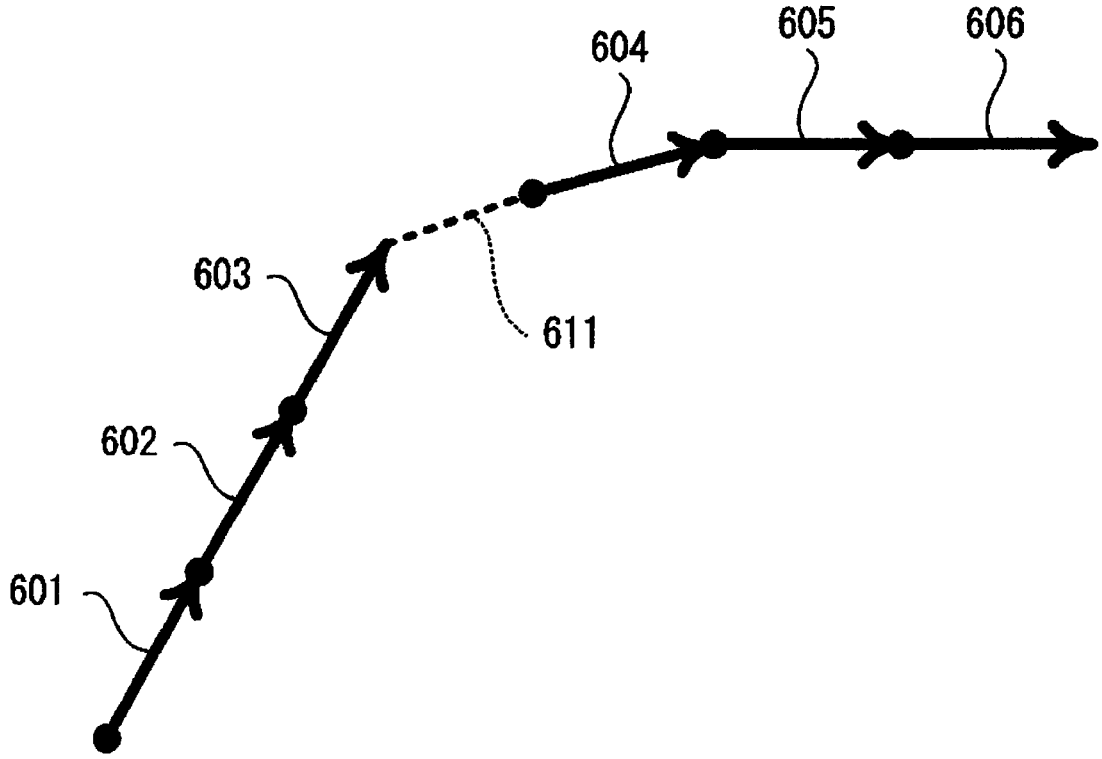
FIG. 13 schematically depicts a segment and a target segment.
Figure 14:
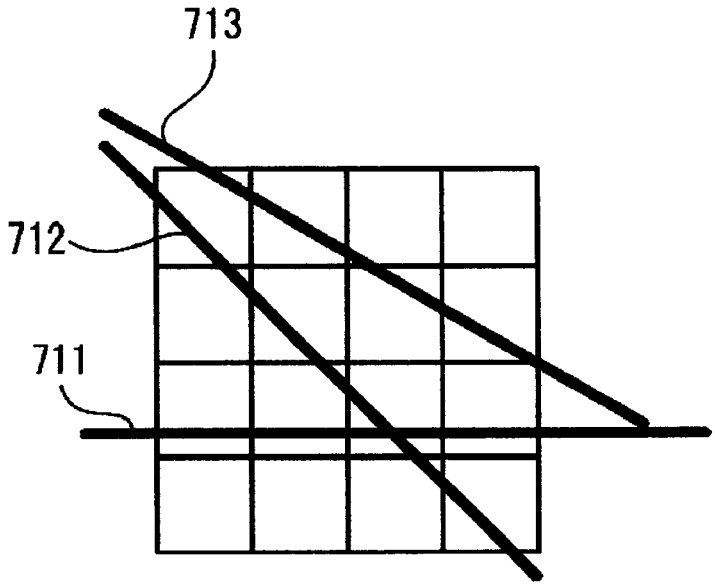
FIG. 14 schematically depicts pass-through segments 711 to 713 passing through a given group of 16 pixels residing in a 4×4 area.

Next, CPU 11 executes a segment appending process (refer to S13 of FIG. 6). In the segment appending process, CPU 11 executes a process in attempt to reduce the number of "jump stitches". As described earlier, if the end point of the focus segment and the start point of the subsequent segment are not coincidental, the end point of the focus segment and the start point of the subsequent segment are connected by a jump stitch. The segment (connecting the end point of the focus segment with the start segment of the subsequent segment) represented as "jump stitch" will be identified as a "target segment" hereinafter. CPU 11 appends the "target segment" in the color segment data as a "running stitch" segment when a prescribed condition is met. As schematically shown in FIG. 13, for instance, segments 601 to 606 are "running stitch" segments constituting the color segment data. The start points of segments 601 to 606 are represented by a dot and the end points are represented by arrows. Segment 603, segment 604, and segment 611 represented by a dotted line correspond to "focus segment", "subsequent segment" and "target segment", respectively.

As can be seen in FIG. 6, CPU 11 generates angular information for all the color segment data (S21). More specifically, CPU 11 allocates storage space in the angular information storage area of RAM 12 for storing pixels equivalent to the number of pixels constituting the inputted image at S1 in the exact same aspect ratio. CPU 11 identifies the segments constituting color segment data as a "pass-through segment". Then, among the pixels retained in the area information storage area, CPU 11 identifies the pixels where the segment passes through as a "pass-through pixel". Then, CPU 11 stores the angle of the pass-through segment as "angular information" in the storage space of the angular information storage area corresponding to the pass-through pixel. CPU 11 stores the angular information for all the segments constituting the color segment data according to the determined segment sequence. In other words, CPU 11 adopts the angle of the last passed segment as the angular information. Angle of pass-through segment is represented in the range of 0 to 180 degrees. For instance, 270 degrees is represented as 90 degrees.

Figure 15:
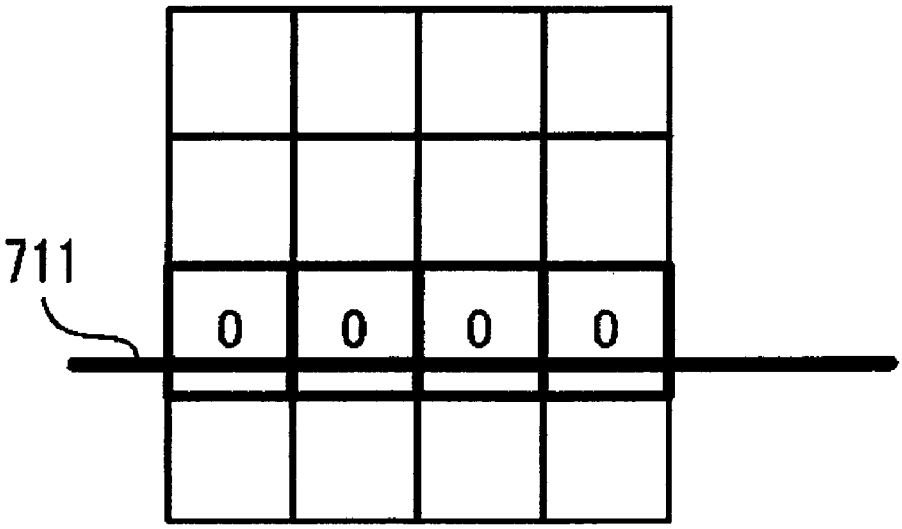
FIG. 15 schematically indicates angular information representing pass-through segment 711.
Figure 16:
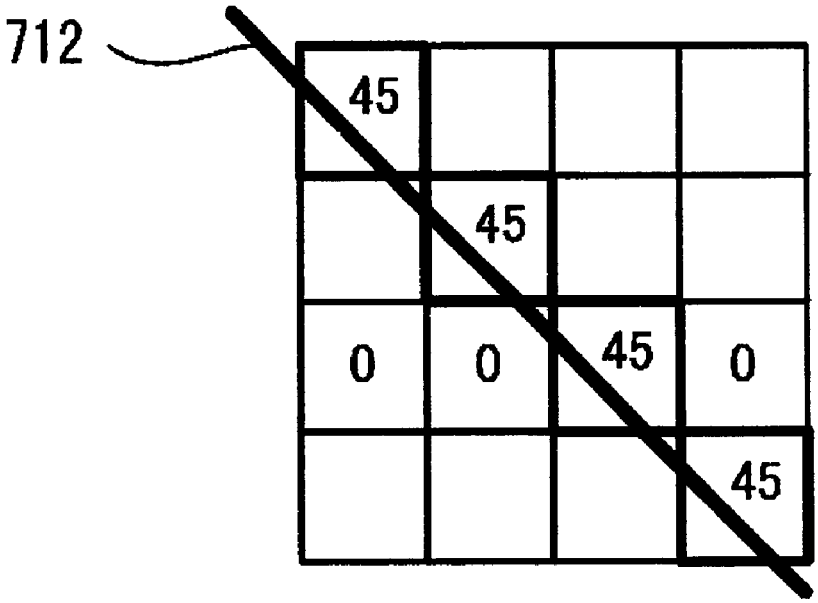
FIG. 16 schematically indicates angular information representing pass-through segment 712.

The process of determining the angular information will be detailed hereinafter with reference to FIGS. 14 to 18. The following description is based upon an assumption that sewing sequence of pass-through segments 711 to 713 are arranged in the sequence of pass-through segment 711, pass-through segment 712, and pass-through segment 713. The angle of pass-through segment 711 is "0" as described earlier, and thus, angular information of pass-through pixel of pass-through segment 711 is set to "0" as can be seen in FIG. 15. Next, as shown in FIG. 16, since the angle of pass-through segment 712 is 45 degrees, angular information of pass-through segment 712 is set to "45". Of note is that pixels that have been previously set to "0" will be overwritten to the angle of pass-through segment "45" of the later sequence. Then, as shown in FIG. 17, since the angle of pass-through segment 713 is 30 degrees, angular information of pass-through pixel is set to "30". As described earlier, CPU 11 overwrites pixels set to angular information "45" to "30" which is the angle of pass-through segment sewn later in the sequence. As for the pixels where segments do not pass through, values other than 0 to 180 are set to angular information as can be seen in FIG. 18 (in the example shown in FIG. 18, "−1" is set to the angular information).

Next, CPU 11 obtains the target segment (S22). More specifically, starting from the first segment in the color segment data, CPU 11 sequentially processes each segment one by one by identifying the processing segment as a "focus segment". At this instance, CPU 11 identifies the segment positioned immediately after the focus segment in the sewing sequence as "subsequent segment". Then, CPU 11 compares the location (coordinate) of the end point of the target segment and the location (coordinate) of the start point of the subsequent segment and searches for a pair of target segment and the subsequent segment in which the locations of the start point and the end point are not coincidental. When encountering such pair for the first time, CPU 11 identifies the segment connecting the end point of the focus segment and the start point of the subsequent segment as the "target segment". In the example shown in FIG. 13, CPU 11 does not extract the pair of the first segment 601 and the second segment 602 since the end point of the segment 601 and the start point of the segment 602 are coincidental. Likewise, CPU 11 does not extract the pair of second segment 602 and third segment 603 for the same reason. Since the end point of third segment 603 and the start point of fourth segment 604 are not coincidental, CPU 11 extracts the pair of third segment 603 and fourth segment 604 and segment 611 is identified as "target segment".

Then, CPU 11 determines whether or not all the target segments have been processed (S23). If CPU 11 fails to obtain a target segment after search has been completed for the last color segment data at S22, CPU 11 makes a determination that all the target segments have been processed (S23: YES). If CPU 11 obtains a target segment, it is an indication that there is a target segment yet to be processed (S23: NO). In such case, CPU 11 calculates a coverage for determining whether or not the first condition is met (S24). Coverage indicates the magnitude in which the target segment is covered by other segments (running stitches). CPU 11 extracts the segment (overpass segment) that intersects the target segment from among the segments which are later in the sequence relative to the subsequent segment. Then, among the pixels corresponding to the target segment (target segment pixels), CPU 11 considers the quotient of the count of pixels overlapping with the pixels corresponding to the overpass segment ("overpass segment pixels") divided by count of target segment pixel as the coverage.

Figure 19:
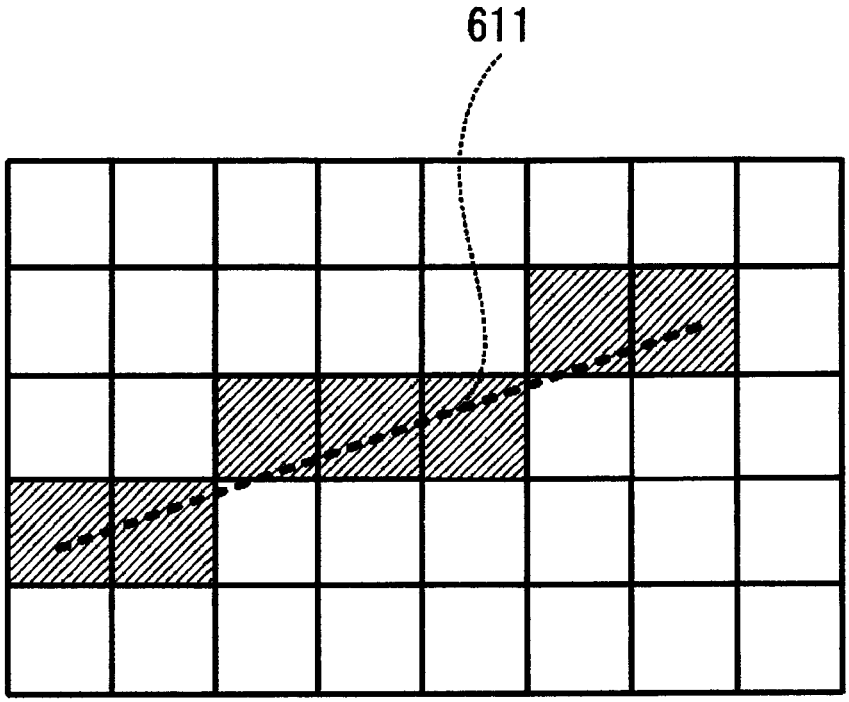
FIG. 19 schematically depicts pass-through segments 611 to passing through a given group of 40 pixels residing in a 5×8 area.
Figure 20:
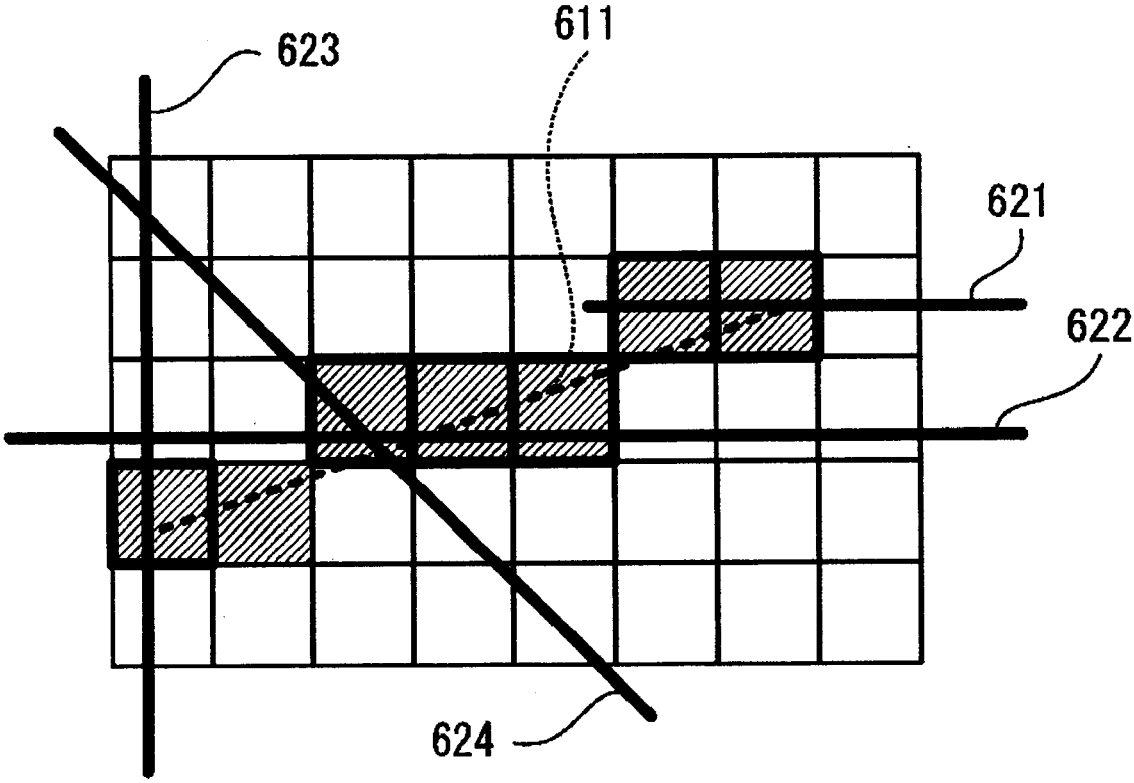
FIG. 20 schematically depicts 4 overpass segments 621 to 624 associated with target segment 611.

Next, a description will be given on the method of calculating the coverage with reference to FIGS. 19 and 20. Pixels being shaded in FIG. 19 are the target segment pixels of target segment 611. In this case, there are 7 target segment pixels. As can be seen in FIG. 20, among the target segment pixels, the 6 pixels, being bordered in bold, overlap with the overpass segment pixels. Thus, in this case, coverage is approximately 0.86 given by $6 \div 7 \approx 0.86$.

Next, CPU 11 determines whether or not the coverage is equal to or greater than the first threshold (S25). In the present exemplary embodiment, the first threshold is set to "0.75", for example. If the coverage is equal to or greater than the first threshold (S25: YES), predetermined percentage or greater percentage of the target segment is covered by other stitches (running stitches). This means that even if the target segment sewn as a "running stitch" instead of a "jump stitch", predetermined percentage or greater percentage of the segment is covered by other stitches (running stitches). As the first threshold approximates 1, the resulting embroidery suffers relatively less adverse effects but will have fewer chances to convert jump stitches into running stitches. Contrastingly, as the first threshold becomes distant from 1, the resulting embroidery suffers relatively greater adverse effects but will have greater chances to convert jump stitches into running stitches. The first threshold is adjusted in view of the above described trade offs.

If coverage is equal to or greater than the first threshold, (S25: YES), CPU 11 appends the target segment to the color segment data (S30) such that it is appended immediately after the focus segment and immediately before the subsequent segment. That is the focus segment, the target segment, and the subsequent segment are arranged in listed sequence. As the "jump stitch" is converted into "running stitch", fastening stitches need not be formed to prevent disintegration of stitches and thus contributing to reducing thread consumption. Then, CPU 11 returns to S22 and obtains the subsequent target segment (S22). This time CPU 11 starts the search from the subsequent focus segment of the sequence.

Further, if the coverage is not equal to or greater than the first threshold (S25: NO) at S25, a sum of color difference is calculated (S26) in order to determine whether or not the second condition is met. The "sum of color difference" indicates the magnitude of similarity between the stitch color of the target segment and the stitch color of the underlying stitch when the target segment is sewn as "running stitch". CPU 11 extracts segments that intersect the target segment from the segments sewn prior to the focus segment. Such extracted segments are identified as underpass segments. The extraction of underpass segments by CPU 11 is not limited to the color segment data currently being processed, but is also extended to all the segments contained in the color segment data of thread colors being sewn prior to the currently processed color segment data. Then, CPU 11 calculates color difference Cd for pixels corresponding to intersection(s) of the target segment and the underpass segment from among the target segment pixels based on equation (4). The color component comprises RGB values. In the following equation (4), "wR" represents the R value of the target segment and likewise, "wG" represents the G value, and "wB" represents the B value. Similarly, "iR" represents the R value of the underpass segment, and "iG", the G value of the underpass segment, and "iB", the B value of the underpass segment. As can be seen in equation (4), color difference Cd is the sum of the squared difference of each color component. If a given target segment pixel serves an intersecting pixel for more than one underpass segment, CPU calculates color difference Cd for each underpass segment. The total sum of the calculated color difference Cd is considered as the "sum of color difference".

$$Cd=\sqrt{|iR-wR|^2+|iG-wG|^2+|iB-wB|^2} \quad (4)$$

After calculating the "sum of color difference" (S26), CPU determines whether or not the "sum of color difference" is equal to or less than the second threshold (S27). For instance, a determination is made as to whether or not the "sum of color difference" is equal to or less than 30. If a "jump stitch" is converted into a "running stitch" when the "sum of color difference" is not equal to or less than the second threshold (S27: NO), the resulting "running stitch" will stand out since the level of color difference relative to the underlying stitch is relatively high. Thus, in such case, the process proceeds to S22 without appending the target segment to the color segment data.

Figure 26:
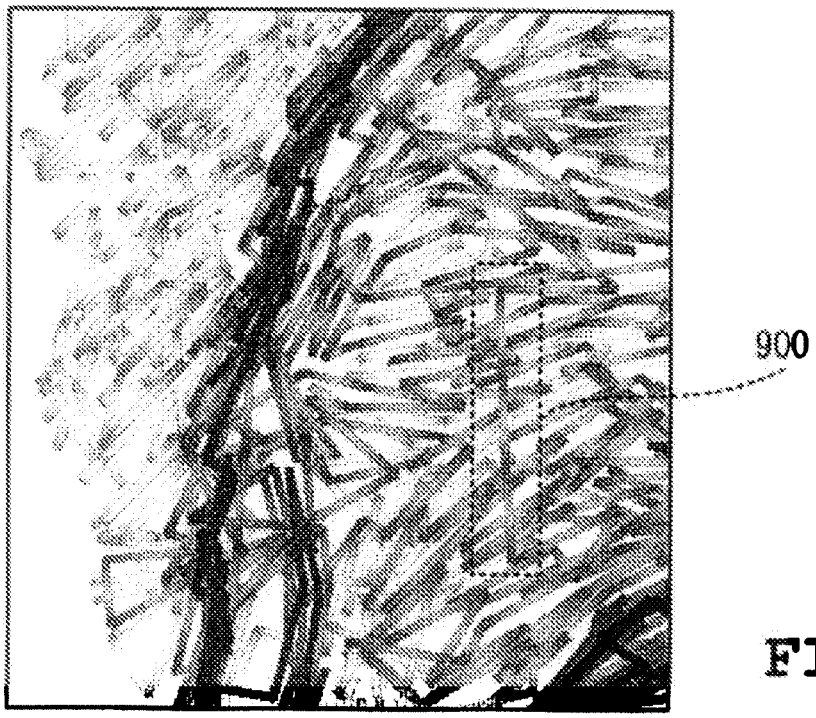
FIG. 26 exemplifies a problem conventionally encountered in a sewing operation.

Further, if a "jump stitch" is converted into a "running stitch" when the "sum of color difference" is equal to or less than the second threshold (S27: YES), the resulting "running stitch" will not stand out since the level of color difference relative to the underlying stitch is relatively low. Given the fact that "sum of color difference" is reduced as the length of the target segment becomes shorter (as the number of target segment pixels is smaller), there is a higher possibility of meeting the second condition. However, if the orientation of the stitch differs significantly from the underlying stitches (refer to FIG. 26), the stitch will stand out regardless of small color difference, consequently affecting the look of the resulting embroidery. To address such problem, CPU 11 determines whether or not a third condition is met (S28 and S29).

As the first step of determining whether or not the third condition is met, CPU 11 calculates "sum of angular difference" (S28). In the second condition, "sum of color difference" was evaluated when the target segment was sewn as a "running stitch" to indicate the degree of similarity between the stitch color of the target segment and the stitch color of the underlying segment. In the third condition, "sum of angular difference" is evaluated to indicate the degree of similarity between the stitch angle of the target segment and the underlying segment. CPU 11 utilizes the angular information and angle of the target segment obtained at S21 when calculating the "sum of angular difference". CPU 11 reads the angular information of the pixel corresponding to the target segment pixels from angular information storage area of RAM 12 and calculates the difference from the angle of the target segment. CPU 11 considers the sum of the calculated differences as "sum of angular difference".

Figure 21:
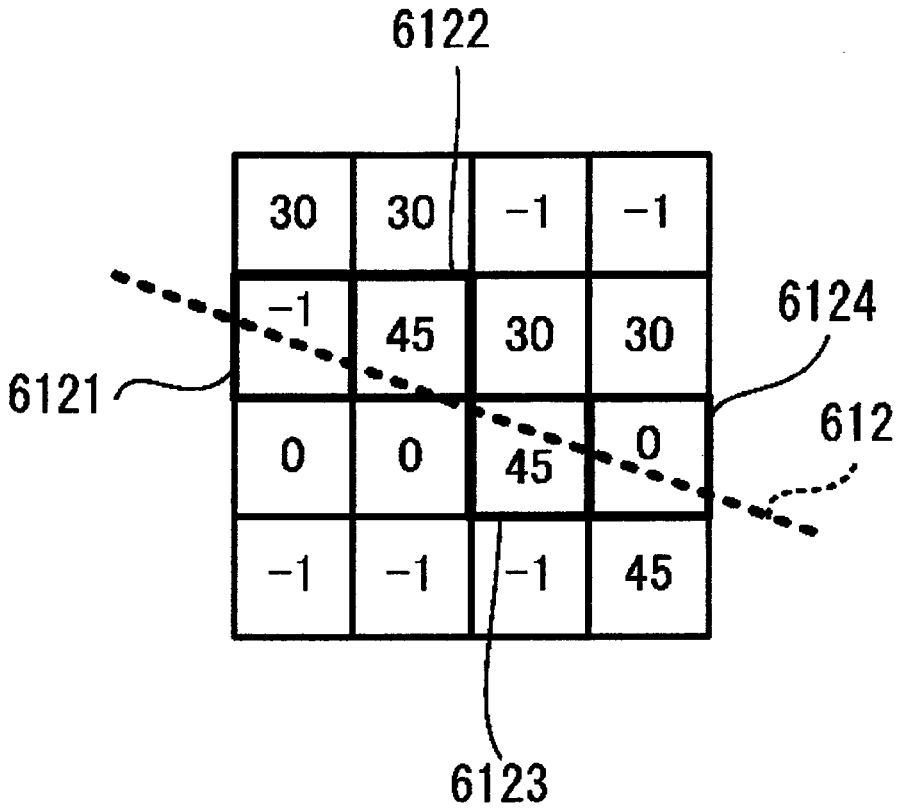
FIG. 21 schematically depicts a target segment 612 having an angle of 20 degrees disposed on the pixel area of FIG. 18.

The above described calculation process will be described by way of example with reference to FIG. 21. FIG. 21 shows a target segment 612 angled at 20 degrees passing through a portion of the pixel area shown in FIG. 18. The angular information of target segment pixel 6121 is "−1" which means that it does not fall within the range of 0 to 180 degrees and thus, it can be understood that no segment passes through the target segment pixel 6121. Hence, CPU 11 does not calculate the angular difference for target segment pixel 6121. Since the angular information of the target segment pixel 6122 is "45", the angular difference is given by the equation "|20−45|=25". Likewise, since the angular information of the target segment pixel 6123 is "45", the angular difference is given by the equation "|20−45|=25". As for the target segment pixel 6124, since the angular information is "0", the angular difference is given by the equation "|20−0|=20". Thus, the "sum of angular difference" can be given by "25+25+20=70".

Figure 22:
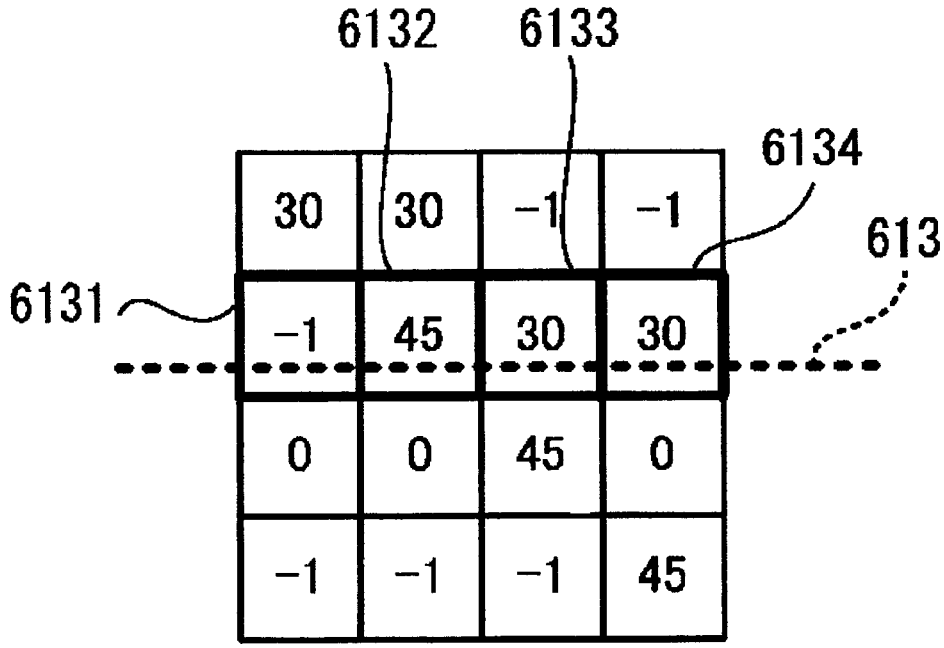
FIG. 22 schematically depicts a target segment 613 having an angle of 0 degrees disposed on the pixel area of FIG. 18.

To describe by way of another example, FIG. 22 shows a 0 degree target segment 613 passing through a portion of the pixel area shown in FIG. 18. In this case, pixels 6131 to 6134 are considered as target segment pixels. The angle of target segment 613 is 0 degrees as described earlier. Since angular information of target segment pixel 6131 is "−1", not falling within the range of 0 to 180 degrees, it can be understood that no segment passes through target segment pixel 6131. Hence CPU 11 does not calculate the angular difference for target segment pixel 6131. Since the angular information of the target segment pixel 6132 is "45", the angular difference is given by the equation "|0−45|=45". Likewise, since the angular information of the target segment pixel 6133 is "30", the angular difference is given by the equation "|0−30|=30". As for the target segment pixel 6134, since the angular information is "30", the angular difference is given by the equation "|0−30|=30". Thus, the "sum of angular difference" can be given by "45+30+30=105".

After calculating the "sum of angular difference" (S28), CPU 11 determines whether or not the calculated "sum of angular difference" is equal to or less than the third threshold value (S29). In the present exemplary embodiment, the third threshold is set to "75", for example. According to the example shown in FIG. 21, since the "sum of angular difference" is "70", a determination is made to consider the third condition to be met (S29: YES). According to the example shown in FIG. 22, since the "sum of angular difference" is "105", a determination is made to consider that the third condition is not met (S29: NO).

If the "jump stitch" is converted into "running stitch" when the "sum of angular difference" is equal to or less than the third threshold (S29: YES), the converted running stitch will not stand out since the difference in stitch angle relative to the running stitches sewn under the converted running stitch is relatively small. Since the converted running stitch will not affect the look of the resulting embroidery, the target segment is appended to the color segment data (S30). If the "jump stitch" is converted into "running stitch" when the "sum of angular difference" is not equal to or less than the third threshold (S29: NO), meaning that angular difference is relatively large, the converted running stitch will stand out even if the color difference relative to the running stitches sewn under it is relatively small. Since the converted running stitch may affect the look of resulting embroidery, the target segment is not appended to the color segment data and the control flow returns to S22.

Then, CPU 11 returns the control flow to S22, and obtains the subsequent segment to determine whether or not to append the obtained segment data to the color segment data (S24 to S29) CPU 11 appends the obtained segment to the color segment data if the conditions are met (S30). CPU 11 repeats S22 to S30 thereafter. If no further target segment is obtained at S22, and all the target segments have been processed (S23: YES), a determination is made as to whether or not all the color segment data have been processed (S31). If CPU 11 encounters color segment data yet to be processed (S31: NO), the process returns to S22 and obtains the target segments from the newly encountered color segment data. Then, CPU 11 determines whether or not to append the obtained segment data to the color segment data (S24 to S29) and appends the obtained segment to the color segment data if the conditions are met (S30). CPU 11 repeats S22 to S31 and if all the color segment data have been processed (S31: YES), the control flow returns to embroidery data generating process.

Then, in the embroidery data generation process as shown in FIG. 5, after completing the segment appending process (S13), CPU 11 generates embroidery data based on color segment data and stores the embroidery data in embroidery data storage area 156 (S14). Then, CPU 11 returns the control flow to the main routine to terminate the main routine. The embroidery data contains instructions for controlling the sewing operation of the sewing machine. Instructions are issued to specify what kind of stitches are to be formed in which thread color and at which location of the workpiece cloth based on the color segment data. Further instructions are issued to sew the segments constituting the color segment data in the form of running stitches in the specified sequence in the specified thread color set by the color segment data. If the end point of a given running stitch and the start point of the subsequent running stitch are not coincidental, an instruction is issued to form a jump stitch from the end point of the running stitch to the start point of the subsequent start point.

As described above, in the segment appending process, CPU 11 appends the target segment data meeting the prescribed conditions to the color segment data and generates the embroidery data based on the color segment data. By appending the target segment to the color segment data, CPU 11 converts stitches to be formed as "jump stitches" into "running stitches". Thus, "jump stitches" can be reduced without affecting the resulting embroidery. Jump stitches require formation of "fastening stitches" for each segment which affects the quality of the resulting embroidery. Further, fastening stitches increase thread consumption and consequently increase the overall sew time. Moreover, jump stitches need to be removed by the user after the sewing operation, which is a troublesome task on the part of the user. Reduction of jump stitches will naturally reduce the occurrence of such problems.

A computer readable medium storing the embroidery data generating program of the present disclosure executed by the embroidery data generator as described in the above described exemplary embodiment may be modified or expanded as follows.

The first threshold being set at "0.75" at S25 of the above described exemplary embodiment may be modified as required. The setting may be fixed or may be modified by the user as required.

The coverage being evaluated to determine if it is equal to greater than the first threshold at S25 may be evaluated to determine if it is greater than the first threshold to exclude the first threshold instead.

The second threshold being set to "30" in the above described embodiment may be modified as required. The setting may be fixed or may be modified by the user.

The sum of color difference being evaluated to determine if it is equal to or less than the second threshold at S27 may be evaluated to determine if it is less than the second threshold to exclude the second threshold instead.

The third threshold being set to "70" in the above described embodiment may be modified as required. The setting may be fixed or may be modified by the user.

The sum of angular difference being evaluated to determine if it is equal to or less than the third threshold at S29 may be evaluated to determine if it is less than the third threshold to exclude the third threshold instead.

In the above described exemplary embodiment, "sum of angular difference" has been employed as the third condition. The "sum of angular difference" is calculated by reading the angular information of the pixels corresponding to the target segment pixels from angular information storage area of RAM 12 and summing up their difference from the angle of the target segment. If the "sum of angular difference" is equal to or less than the third threshold, the third condition was considered to have been met. The downside of this approach is that, even if the difference between the angle of the targeted segment and the angular information of each pixel is small, in case the target segment is long, meaning that there is relatively large number of target segment pixels, the resulting "sum of angular difference" may become greater than the third threshold. For instance, even if angular difference is 5 degrees, if there are 15 target segment pixels, the "sum of angular difference" amounts to "75". Thus, in a modified exemplary embodiment to address such problem, a fourth and fifth threshold may be further incorporated into the third condition. If the number of pixels having an angle exceeding the fourth threshold is less than the fifth threshold, it is determined to have met the third condition. The forth threshold in this case may be "30" and the fifth threshold may be "2", for example.

Figure 23:
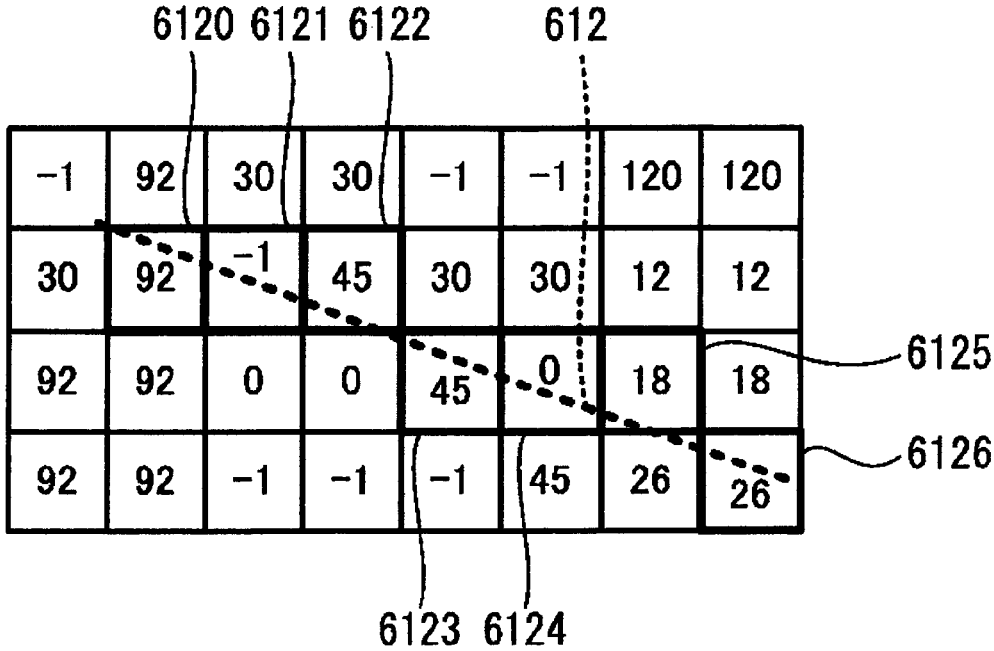
FIG. 23 depicts a broader perspective of FIG. 21 showing further peripheral pixels.

The above described modified example is described by way of example shown in FIG. 23. FIG. 23 schematically depicts the pixel area shown in FIG. 21 in a broader perspective. In this case, pixels 6120 to 6126 are identified as the target segment pixels. The angle of target segment 612 is 20 degrees. Since the angular information of the target segment pixel 612 is "92", the angular difference can be given by "|20−92|=72". The angular information of target segment pixel 6121 is "−1" which means that it does not fall within the range of 0 to 180 degrees. Thus, it can be understood that no segment passes through the target segment pixel 6121 and hence angular difference is not calculated for target segment pixel 6121. Since the angular information of the target segment pixel 6122 is "45", the angular difference is given by the equation "|20−45|=25". Likewise, since the angular information of the target segment pixel 6123 is "45", the angular difference is given by the equation "|20−45|=25". As for target segment pixel 6124, since the angular information is "0", the angular difference is given by the equation "|20−0|=20". For target segment pixel 6125, since the angular information is "18", the angular difference is given by the equation "|20−18|=2". Finally, for target segment pixel 6126, since the angular information is "26", the angular difference is given by the equation "|20−26|=6". According to the above described modified exemplary embodiment, "sum of angular difference" can be given by "72+25+25+20+2+6=150". In this case, since the sum is greater than "70", it is determined that the third condition is not met, and target segment 612 is not appended to the color segment data under the previous exemplary embodiment. However, when applying the third condition of the modified exemplary embodiment, the only pixel exceeding the threshold "30" is target segment pixel 6120 having angular information of "72". Thus, since the number of pixels exceeding the exemplary fourth threshold is "1" which is less than the exemplary fifth threshold "2", it is determined that the third condition is met.

Figure 24:
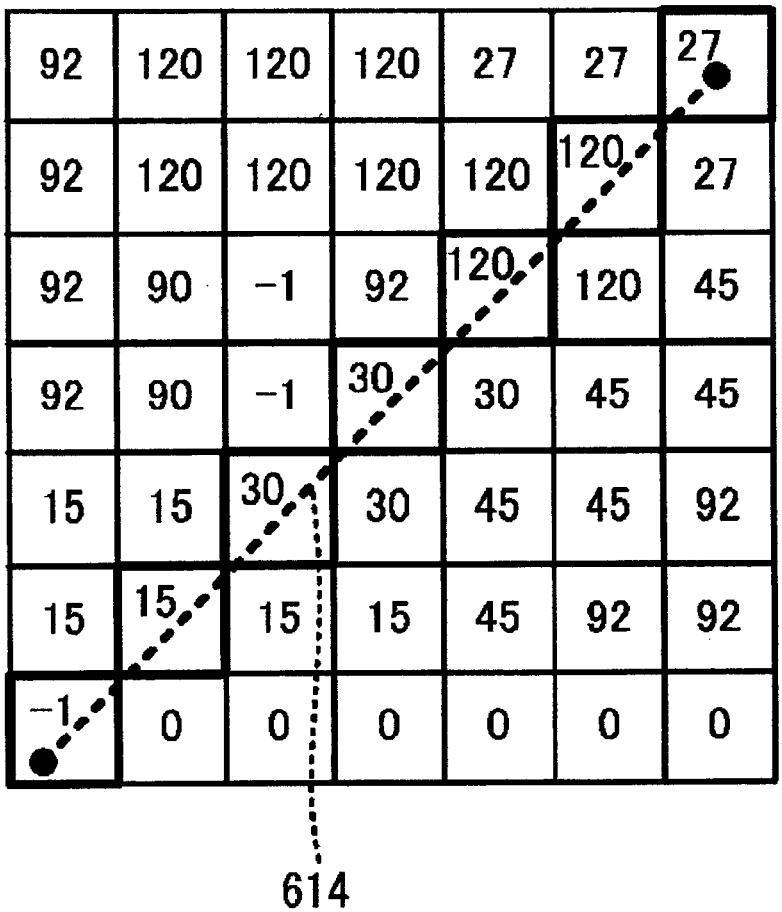
FIG. 24 schematically depicts the pixels associated with target segment 614.
Figure 25:
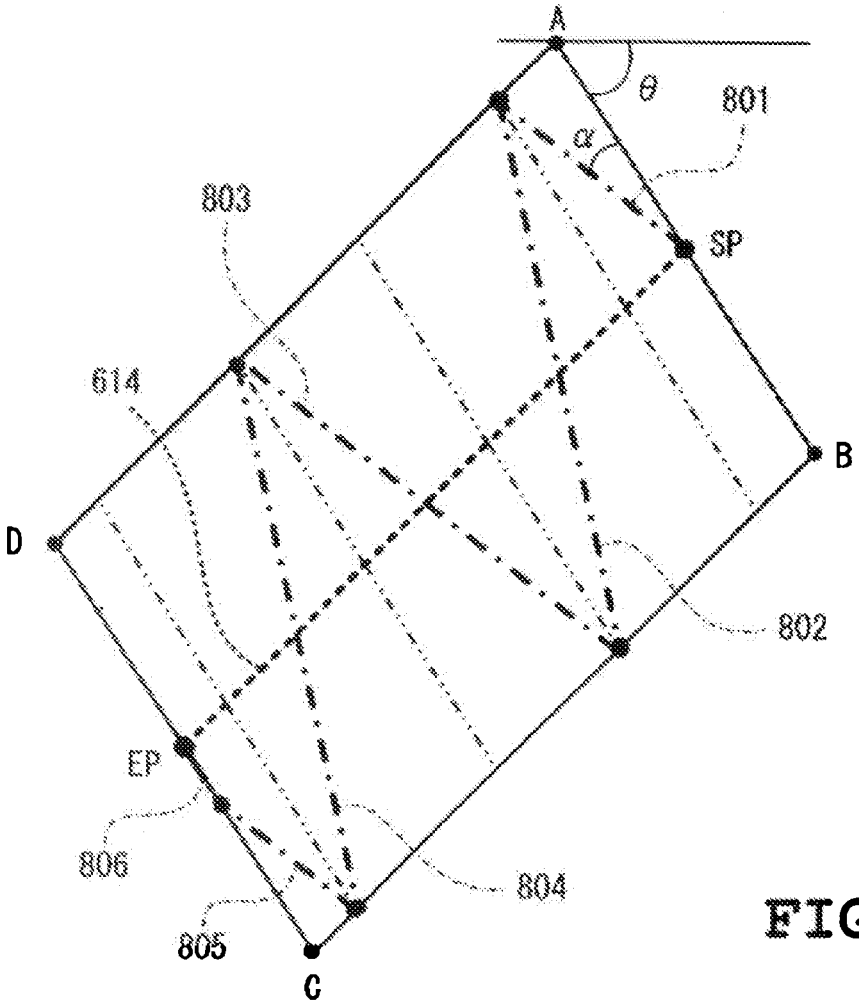
FIG. 25 describes a method of converting target segment 614 into a segment.

In the above described modified exemplary embodiment, the target segment determined to be excluded from the color segment data (the segment failing to meet the third condition) may be further processed so that it may be appended to the color segment data if it meets certain criteria. One example of such criteria may be converting the target segment into multiple segments (hereinafter referred to as converted segments) and evaluating the converted segments against the first to third conditions. If the all the converted segments meet either of the first to third conditions, the converted segments may be appended to the color segment data. Referring to FIGS. 24 and 25, the conversion of the target segment will be described in more detail.

First, average θ of the angular information of the target segment pixels is calculated. FIG. 24 exemplifies 7 target segment pixels having angular information of "−1", "15", "30", "30", "120", "120", and "27" respectively. As described earlier, "−1" indicates that no segment passes through the relevant segment. The average θ of the seven target segment pixels can be given by (15+30+30+120+120+27)/(7−1)=57. The average θ can be considered to represent the average orientation of the stitches being formed under the target segment. In other words, when the target segment is sewn by a running stitch, the stitches sewn under the target segment is generally oriented in the direction of angle θ. Target segment 614 may be converted into a segment having an angle approximating angle θ to generate a converted segment. The angle approximating angle θ is represented as θ+α and θ−α. Angle α may be any given value which is greater than 0 degrees but less than 180 degrees. The angle of the converted segment approximates θ as α approaches either 0 degrees or 180 degrees, but will result in greater number of converted segments. In contrast, as α approaches 90 degrees, the number of converted segments decrease but the angle of converted segments become distant from angle θ. The user may determine the α in view of the above trade offs.

A method of converting target segment 614 will be detailed with reference to FIG. 25. As can be seen in FIG. 25, the start point of target segment 614 is represented as SP and the end point is represented as EP. As the first step of the process, an auxiliary line AB having an angle of θ and a length equivalent to the stitch pitch is passed through start point SP such that start point SP is located at its midpoint. Similarly, an auxiliary line CD having an angle of θ and a length equivalent to the stitch pitch is passed through end point EP such that end point EP is located at its midpoint. Then, end points of AB are connected with end points of CD such that the connecting lines do not intersect each other, which result in auxiliary lines AD and BC. Auxiliary lines AB, BC, CD, and AD form a parallelogram ABCD that contain the converted segments.

First, a straight line is calculated that passes start point SP and having an angle of θ−α. Then, the intersection of the straight line and the parallelogram is calculated to determine a segment connecting the start point SP and the intersection. This segment is identified as a first converted segment and is represented as converted segment 801 in the example shown in FIG. 25. Next, a straight line is calculated that passes the end point of the first converted segment and having an angle of θ+α. Then, the intersection of the straight line and the parallelogram is calculated to determine a segment connecting the end point of the first converted segment and the intersection. This segment is identified as a second converted segment and is represented as converted segment 802. Next, a straight line is calculated that passes the end point of the second converted segment and having an angle of θ−α. Then, the intersection of the straight line and the parallelogram is calculated to determine a segment connecting the end point of the second converted segment and the intersection. This segment is identified as a third converted segment and is represented as converted segment 803. As described above, converted segments are generated that fold back within the parallelogram alternately by angles θ+α and θ−α. In case any of the straight lines intersect with segment CD on which end point EP resides, the next segment will extend from the intersection to end point EP. In the above modified exemplary embodiment, initial converted segment passing start point SP may be angled at θ+α instead of θ−α.

Target segment 614 is converted into series of converted segments 801 to 806 as described above. For each of converted segments 801 to 806, a determination is made as to whether or not the first condition is met, and if not whether or not the second condition and the third condition are met. If all the converted segments meet the first condition or if not meet the second and the third conditions, the converted segments are appended to the color segment data. In the example shown in FIG. 25, converted segments are appended to the color segment data sequentially from converted segment 801 to 806. More specifically, after executing the segment appending process of S24 to S29 shown in FIG. 6, if either the second condition (S27: No) or the third condition is not met (S29: No), a determination is made to not append the converted segments to the color segment data. However, if the first condition is met (S25: YES) or the third condition is met (S29: YES), S24 to S29 are executed for the subsequent converted segment. If the first condition is met (S25: YES) or the third condition is met (S29: YES) for the last converted segment, all of the converted segments are appended on the color segment data.

As described above, a target segment which would not have been appended to the color segment data and thus would not have been converted from a "jump stitch" to a "running stitch" may be converted into multiple converted segments that meet the conditions to be appended to the color segment data and converted from a "jump stitch" to a "running stitch". Such arrangement further reduces the occurrence of "jump stitches".

The functionality of embroidery data generator 1 may be incorporated into embroidery sewing machine 3.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data generating apparatus for use in forming embroidery with a sewing machine based on image data configured by multiplicity of pixels that represent a given image, the embroidery data generating apparatus comprising:

an angular feature information calculator that calculates angular feature information configured by an angular feature indicative of orientation showing high degree of color continuity and an angular feature magnitude indicative of color continuity magnitude for each pixel configuring the image data;

an angular feature information storage that stores the angular feature information;

a segment data generator that generates segment data that describes placement of segments, representing sewing threads, overlying each of the pixels based on the angular feature information stored in the angular feature information storage;

a color data generator that generates color data indicative of sewing thread color of each segment described in the segment data based on the image data;

a segment sequence determiner that determines sequence of the segments within the segments classified by color based on the segment data and the color data;

a sequence information storage that stores sequence information indicative of the sequence of segments determined by the segment sequence determiner;

a first determiner that determines whether or not to append a target segment to the sequence information depending upon whether or not the target segment is covered by a predetermined percentage or greater by an overpass segment overlying the target segment, the target segment being a segment connecting an end point of a focus segment and a start point of a subsequent segment being subsequent in sequence to the focus segment;

a first segment appender that appends the target segment between the focus segment and the subsequent segment of the sequence information when determined by the first determiner to append the target segment to the sequence information;

a color difference calculator that calculates a color difference between sewing thread color of the target segment and sewing thread color of an underpass segment underlying the target segment;

a second determiner that determines whether or not a sum of the color difference for all the underpass segments associated with the target segment is equal to or less than a first predetermined value;

an angular difference calculator that calculates an angular difference between the underpass segment and the target segment, the angular difference being measured at an intersecting pixel where the target segment and the underpass segment intersect;

a third determiner that determines whether or not to append the target segment to the sequence information based on the angular difference when the sum of the color difference is determined to be equal to or less than the first predetermined value;

a second segment appender that appends the target segment between the focus segment and the subsequent segment of the sequence information when determined by the third determiner to append the target segment to the sequence information; and an embroidery data generator that generates, based on the sequence of the segments indicated in the sequence information, embroidery data that identifies the segment as a running stitch and if an endpoint of the segment and a start point of a subsequent segment subsequent in sequence are not coincidental, the end point of the segment and the start point of the subsequent segment are identified to be joined by a jump stitch.

2. The embroidery data generating apparatus according to claim 1, further comprising an angular difference sum calculator that calculates a sum of angular differences for all the underpass segments associated with the target segment, wherein the third determiner determines to append the target segment to the sequence information when the sum of angular difference is equal to or less than a second predetermined value.

3. The embroidery data generating apparatus according to claim 1, further comprising a pixel counter that counts number of intersecting pixels having the angular differences which are greater than a third predetermined value, wherein the third determiner determines to append the target segment to the sequence information when the number of intersecting pixels having greater angular difference than the third predetermined value is equal to or less than a fourth predetermined value.

4. The embroidery data generating apparatus according to claim 1, further comprising an average calculator that calculates an average angle of the intersecting pixels for all the underpass segments associated with the target segment when determined by the third determiner not to append the target segment to the sequence information, a first incline calculator that calculates a first incline by adding a first predetermined value to the average angle, a second incline calculator that calculates a second incline by subtracting the first predetermined angle from the average angle, a parallelogram former that forms a parallelogram configured by a first pair of segments being identical in length and incline to the target segment and a second pair of segments having predetermined lengths and being inclined by the average angle, a midpoint of each segment of the second pair defining endpoints of the target segment, a segment generator that generates a series of segments originating from one end point of the target segment and being inclined by the first incline or the second incline to inscribe the parallelogram, the series of segments being disposed such that when an endpoint of the series of segments reside on either of the second pair of segments, the end point serves as a start point of a final segment that terminates at a remaining other end of the target segment, and a segment appender that appends the series of segments between the focus segment and the subsequent segment of the sequence information when all the series of segments collectively being identified as the target segment have been determined to be appended to the sequence information by either of the first to third determiners.

5. A computer readable medium storing an embroidery data generating program for use in forming embroidery with a sewing machine based on image data configured by multiplicity of pixels that represent a given image, the embroidery data generating program, comprising:

instructions for calculating angular feature information configured by an angular feature indicative of orientation showing high degree of color continuity and an angular feature magnitude indicative of color continuity magnitude for each pixel configuring the image data;

instructions for storing the angular feature information;

instructions for generating segment data describing placements of segments, representing sewing threads, overlying each of the pixels based on the angular feature information;

instructions for generating color data indicative of sewing thread color of each segment of the segment data based on the image data;

instructions for determining sequence of the segments within the segments classified by color based on the segment data and the color data;

instructions for storing the sequence information;

instructions for determining whether or not to append a target segment to the sequence information depending upon whether or not the target segment is covered by a predetermined percentage or greater by an overpass segment overlying the target segment, the target segment being a segment connecting an end point of a focus segment and a start point of a subsequent segment being subsequent in sequence to the focus segment;

instructions for appending the target segment between the focus segment and the subsequent segment of the sequence information when determined to append the target segment to the sequence information;

instructions for calculating a color difference between sewing thread color of the target segment and sewing thread color of an underpass segment underlying the target segment;

instructions for determining whether or not a sum of the color difference for all the underpass segments associated with the target segment is equal to or less than a first predetermined value;

instructions for calculating an angular difference between the underpass segment and the target segment, the angular difference being measured at an intersecting pixel where the target segment and the underpass segment intersect;

instructions for determining whether or not to append the target segment to the sequence information based on the angular difference when the sum of the color difference is determined to be equal to or less than the first predetermined value;

instructions for appending the target segment between the focus segment and the subsequent segment of the sequence information when determined to append the target segment to the sequence information; and instructions for generating, based on the sequence of the segments indicated in the sequence information, embroidery data that identifies the segment as a running stitch and if an end point of the segment and a start point of a subsequent segment subsequent in sequence are not coincidental, the end point of the segment and the start point of the subsequent segment are identified to be joined by a jump stitch.

6. The computer readable medium storing the embroidery data generating program according to claim 5, wherein the embroidery data generating program further comprises instructions for calculating a sum of angular differences for all the underpass segments associated with the target segment, wherein the target segment is determined to be appended to the sequence information when the sum of angular differences is equal to or less than a second predetermined value.

7. The computer readable medium storing the embroidery data generating program according to claim 5, further comprising instructions for counting number of intersecting pixels having the angular differences which are greater than a third predetermined value, wherein the target segment is determined to be appended to the sequence information when the number of intersecting pixels having greater angular difference than the third predetermined value is equal to or less than a fourth predetermined value.

8. The computer readable medium storing the embroidery data generating program according to claim 5, further comprising instructions for calculating an average angle of the intersecting pixels for all the underpass segment associated with the target segment when determined not to append the target segment to the sequence information, instructions for calculating a first incline by adding a first predetermined value to the average angle, instructions for calculating a second incline by subtracting the first predetermined angle from the average angle, instructions for forming a parallelogram configured by a first pair of segments being identical in length and incline to the target segment and a second pair of segments having predetermined lengths and being inclined by the average angle, a midpoint of each segment of the second pair defining end points of the target segment, instructions for generating a series of segments originating from one endpoint of the target segment and being inclined by the first incline or the second incline to inscribe the parallelogram, the series of segments being disposed such that when an end point of the series of segments reside on either of the second pair of segments, the end point serves as a start point of a final segment that terminates at a remaining other end of the target segment, and instructions for appending the series of segments between the focus segment and the subsequent segment of the sequence information when all the connecting segments collectively being identified as the target segment have been determined to be appended to the sequence information by either of the determinations.

* * * * *